US009192803B2

(12) United States Patent
Cayo

(10) Patent No.: US 9,192,803 B2
(45) Date of Patent: Nov. 24, 2015

(54) EXERCISE EQUIPMENT SYSTEM

(71) Applicant: Rick Cayo, Medford, OR (US)

(72) Inventor: Rick Cayo, Medford, OR (US)

( * ) Notice: Subject to any disclaimer, the term of this patent is extended or adjusted under 35 U.S.C. 154(b) by 198 days.

(21) Appl. No.: 13/907,955

(22) Filed: Jun. 2, 2013

(65) Prior Publication Data

US 2013/0324371 A1 Dec. 5, 2013

Related U.S. Application Data

(60) Provisional application No. 61/654,943, filed on Jun. 3, 2012.

(51) Int. Cl.
*A63B 69/22* (2006.01)
*A63B 69/24* (2006.01)
(Continued)

(52) U.S. Cl.
CPC ..... *A63B 21/0618* (2013.01); *A63B 21/0602* (2013.01); *A63B 21/078* (2013.01); *A63B 21/1457* (2013.01); *A63B 21/1461* (2013.01); *A63B 23/03525* (2013.01); *A63B 23/047* (2013.01); *A63B 23/0494* (2013.01); *A63B 69/24* (2013.01); *A63B 71/02* (2013.01); *A63B 71/023* (2013.01); *A63B 21/154* (2013.01);
(Continued)

(58) Field of Classification Search
CPC ..... A63B 21/0618; A63B 23/03525; A63B 23/0494; A63B 23/047; A63B 21/1457; A63B 71/02; A63B 21/078; A63B 21/0602; A63B 21/1461; A63B 71/023; A63B 69/24; A63B 2071/025; A63B 21/28; A63B 21/154; A63B 23/1209; A63B 2071/027; A63B 23/1281; A63B 63/008; A63B 69/205; A63B 69/206; A63B 2225/093; A63B 63/083; A63B 2210/50; A63B 69/201; A63B 2071/026; F16M 11/32; G09F 7/18; G09F 2007/1804; G09F 17/00
USPC ..... 482/38, 66, 86–87, 90, 93, 133, 482/138–139; 248/121–126, 558, 676–678, 248/518–519, 530, 218.4, 219.1–219.4; 280/19, 23.1, 28.12, 28.17; 473/116, 473/416, 441, 445, 481–483; 269/40
See application file for complete search history.

(56) References Cited

U.S. PATENT DOCUMENTS 1,185,833 A * 6/1916 Sandeberg ..... 482/87
3,348,247 A * 10/1967 Flannigan ..... 441/65
(Continued)

FOREIGN PATENT DOCUMENTS

WO WO 03066175 A1 * 8/2003

*Primary Examiner* — Oren Ginsberg
*Assistant Examiner* — Joshua Lee
(74) *Attorney, Agent, or Firm* — Keith L. Jenkins, Registered Patent Attorney, LLC; Keith L. Jenkins

(57) ABSTRACT

A sled with tubular runners that have a square aft cross section from which fixable bayonet couplings having three sides of a square extend and can receive a pole support frame's side members which cover the bayonet extensions. The pole support frame supports opposed bearings that rotationally mount a pole axle from which an equipment support pole transversely extends. Two semi-circumferential arrays of holes interact with holes in a fixed angular adjuster, mounted to the pole support frame, to enable multiple discrete fixed angular positions for the pole. The sled can support weights, preferably in the form of containers of water, as well as exercise equipment. The pole can support pole extensions, exercise equipment, and pulleys for guiding cables that connect weight containers to exercise apparatus.

20 Claims, 25 Drawing Sheets

(51) Int. Cl.

| | |
|---|---|
| ***A63B 21/00*** | (2006.01) |
| ***A63B 63/00*** | (2006.01) |
| ***A63B 63/08*** | (2006.01) |
| ***B62M 29/00*** | (2006.01) |
| ***F16M 11/00*** | (2006.01) |
| ***A63B 21/06*** | (2006.01) |
| ***A63B 71/02*** | (2006.01) |
| ***A63B 21/078*** | (2006.01) |
| ***A63B 23/035*** | (2006.01) |
| ***A63B 23/04*** | (2006.01) |
| *A63B 69/20* | (2006.01) |
| *A63B 21/28* | (2006.01) |
| *A63B 23/12* | (2006.01) |

(52) U.S. Cl.

CPC ..... *A63B21/28* (2013.01); *A63B 23/1209* (2013.01); *A63B 23/1281* (2013.01); *A63B 63/008* (2013.01); *A63B 63/083* (2013.01); *A63B 69/201* (2013.01); *A63B 69/205* (2013.01); *A63B 69/206* (2013.01); *A63B 2071/025* (2013.01); *A63B 2071/026* (2013.01); *A63B 2071/027* (2013.01); *A63B 2210/50* (2013.01); *A63B 2225/093* (2013.01)

(56) References Cited

U.S. PATENT DOCUMENTS

| | | | | |
|---|---|---|---|---|
| 3,510,131 | A * | 5/1970 | Gardner | 482/90 |
| 3,827,690 | A * | 8/1974 | Rogers | 473/445 |
| 4,482,150 | A * | 11/1984 | Levine | 482/90 |
| 4,526,367 | A * | 7/1985 | Haston et al. | 473/483 |
| 4,786,053 | A * | 11/1988 | Barnes, Jr. | 473/416 |
| 4,913,388 | A * | 4/1990 | McCant | 248/123.11 |
| 5,299,990 | A * | 4/1994 | Mehlhoff | 482/38 |
| 5,385,523 | A * | 1/1995 | Forrest | 473/445 |
| 6,942,585 | B1 * | 9/2005 | Krause | 473/445 |
| 7,416,412 | B2 * | 8/2008 | Segrest et al. | 434/226 |
| 8,900,074 | B1 * | 12/2014 | Johnson et al. | 473/422 |
| 2007/0191150 | A1 * | 8/2007 | Lu | 473/479 |
| 2007/0259764 | A1 * | 11/2007 | Kelly | 482/904 |
| 2008/0312009 | A1 * | 12/2008 | Gilman | 473/445 |
| 2009/0088303 | A1 * | 4/2009 | Footnick | 482/111 |
| 2011/0124474 | A1 * | 5/2011 | Gilman | 482/93 |
| 2011/0165972 | A1 * | 7/2011 | Forrest, Sr. | 473/445 |
| 2011/0224050 | A1 * | 9/2011 | Larish | 482/93 |
| 2011/0224051 | A1 * | 9/2011 | Larish | 482/93 |
| 2012/0184401 | A1 * | 7/2012 | Shepherd et al. | 473/481 |
| 2013/0012364 | A1 * | 1/2013 | Leath | 482/66 |
| 2013/0095984 | A1 * | 4/2013 | Agate | 482/106 |
| 2013/0172160 | A1 * | 7/2013 | Poole | 482/129 |
| 2013/0184104 | A1 * | 7/2013 | Gilman | 473/445 |

* cited by examiner

300

300

EXERCISE EQUIPMENT SYSTEM

RELATED APPLICATIONS

This application claims the benefit of U.S. provisional patent application 61/654,943 filed Jun. 3, 2012 to the same inventor, the contents of which are hereby incorporated by reference in their entirety.

TECHNICAL FIELD

This invention relates to reconfigurable exercise equipment system. More particularly, it relates to a sled-based reconfigurable exercise equipment system with containerized weights.

BACKGROUND

Exercise equipment is expensive and, despite multi-station exercise equipments, do not provide a broad range of exercise options. The weights used in conventional exercise equipment themselves are often expensive both to purchase and to ship. Much of the conventional exercise equipment is designed for indoor use.

Therefore, a need exists for an exercise equipment system for indoor and/or outdoor use that provides a broad range of exercise options, inexpensive weights, and is comparatively inexpensive to manufacture and to ship.

OBJECTS AND FEATURES OF THE INVENTION

A primary object and feature of the present invention is to overcome the above-mentioned problems and fulfill the above-mentioned needs.

Another object and feature of the present invention is to provide a system that is based on an exercise sled.

It is a further object and feature of the present invention to provide a system that can be reconfigured easily for a broad range of exercises.

It is a further object and feature of the present invention to provide a system that uses inexpensive weights. It is a further object and feature of the present invention to provide a system that uses weights that can be varied as to weight. It is a further object and feature of the present invention to provide a system that uses various attachments for the weights.

It is a further object and feature of the present invention to provide support for a pole that may be angled between vertical and inclined from vertical. It is a further object and feature of the present invention to provide support for the pole to be a telescoping pole.

It is a further object and feature of the present invention to provide support for a person who exercises in a seated or partially seated position. It is a further object and feature of the present invention to provide support for a person who exercises in a reclined or partially reclined position. It is a further object and feature of the present invention to provide various attachments for a person who exercises in a standing, walking, or running position.

It is an additional primary object and feature of the present invention to provide such a system that is efficient, inexpensive and handy. Other objects and features of this invention will become apparent with reference to the following descriptions.

SUMMARY OF THE INVENTION

In accordance with a preferred embodiment hereof, this invention provides a system for achieving the above-mentioned objects of the invention. Weights for the system comprise containers of water, preferably with markings to show different weights for different volumes of water placed therein, that have attachments for hand lifting and for cable lifting. The base unit is a sled that can be weighted down with one or more water containers and pushed or pulled by one or more persons. A first addition to the base unit is a support for a pole that can be positioned vertically, or inclined from vertical in discrete increments by the user to support various additional pieces of exercise equipment. A second addition to the base unit is a central attachment bar over the center of the sled, having holes for attachment pins, and being releasably attached to the sled. An additional feature of the invention is a subsystem for attaching pieces of exercise equipment to the pole. The attachable pole has keyhole-shaped openings and the attachable piece of exercise equipment has a bi-fold hinged collar of two flanged semi-cylindrical sides with one or more protrusions pointing radially inward from one of the semi-cylindrical sides to engage the keyhole-shaped openings before the other side is rotated into encircle a portion of the pole and the flanges are fastened with bolts or the like.

BRIEF DESCRIPTION OF THE DRAWINGS

The present invention will hereinafter be described in conjunction with the following drawing figures, wherein like numerals denote like elements.

DETAILED DESCRIPTION OF THE INVENTION

The term "front" as defined and used herein refers to the preferred direction of sled movement. It should also be understood that the entire exercise equipment system cannot be entirely illustrated in one meaningful illustration, and that only one embodiment of the exercise equipment system is illustrated by the totality of the illustrations and the descriptions below.

Figure 1:
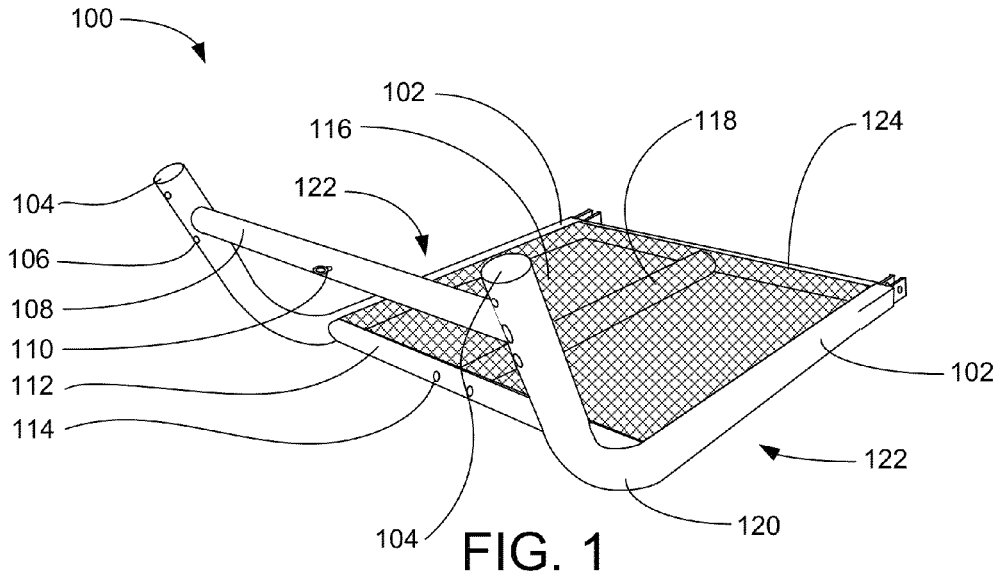
FIG. 1 is a front-side perspective view illustrating an exemplary embodiment of the sled of the exemplary exercise equipment system, according to a preferred embodiment of the present invention.

FIG. 1 is a front-side perspective view illustrating an exemplary embodiment of the sled 100 of the exemplary exercise equipment system, according to a preferred embodiment of the present invention. Sled 100 has parallel side runners 122 having rear straight portions 102 that extend upward arcuately 120 into closed upturned ends 104. Parallel side runners 122 are preferably pipe and more preferably steel pipe. A rear cross bar 124 extends between the posterior ends of rear straight portions 102. A front cross bar 112 extends between forward ends of rear straight portions 102 just before the bend 120, and a top cross bar 108 extends between parallel side runners 122 proximate the closed ends 104. Cross bars 112 and 124 are preferably pipe and more preferably steel pipe. A sled floor panel 116 extends between the front cross bar 112 and the rear cross bar 124 and between the rear straight portions 102 of the parallel side runners 122. Additional support for the sled floor panel 116 is provided by a central support 118, also preferably a steel pipe, which extends between forward cross bar 112 and rear cross bar 124. Sled floor panel 116 is preferably multi-perforate, as shown, for shedding rain and other water, and is preferably strong enough to support at least five hundred pounds. Top cross bar 108 has an attachment point 110, which will be discussed further below. Front cross bar 112 has holes 114 (one of two labeled, which may assist in fastening central support 118 into place. Holes 106 (one of 4 labeled) in parallel side runners 122 assist in attaching some equipment. Rear ends of rear straight portions 102 are flared into a square shape, as shown, to accommodate receivers 202, or end couplings, 202 (see FIG. 2)

Figure 2:
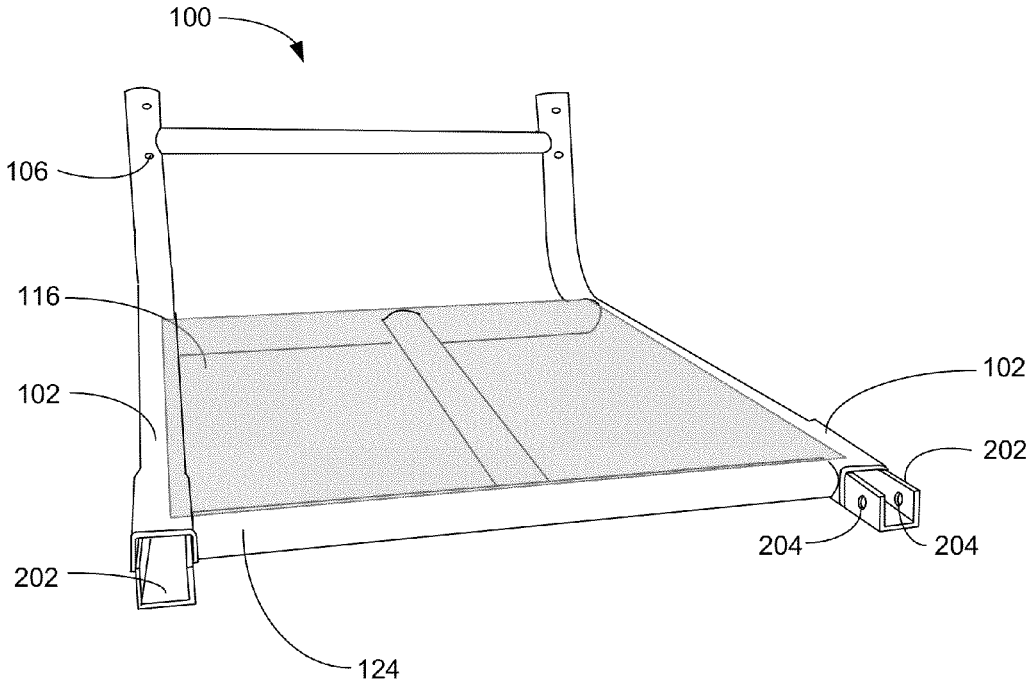
FIG. 2 is a rear-side perspective view illustrating an exemplary embodiment of the sled of the exemplary embodiment of the exercise equipment system of FIG. 1, according to a preferred embodiment of the present invention.

FIG. 2 is a rear-side perspective view illustrating an exemplary embodiment of the sled 100 of the exemplary embodiment of the exercise equipment system of FIG. 1, according to a preferred embodiment of the present invention. Rear ends of rear straight portions 102 provide end couplings 202 for the attachment of an adjustable pole support 301 (see FIG. 3) or the like. For example, the outside dimensions of end couplings 202 slidingly receive the inside dimensions of square attachment covers 406 (see FIG. 4). Holes 204 (two on each end coupling 202) align to holes 320 (see FIG. 3) in the adjustable pole support 301 to receive a fastener, such as a pin, for fastening the adjustable pole support 301 to the sled 100.

Figure 3:
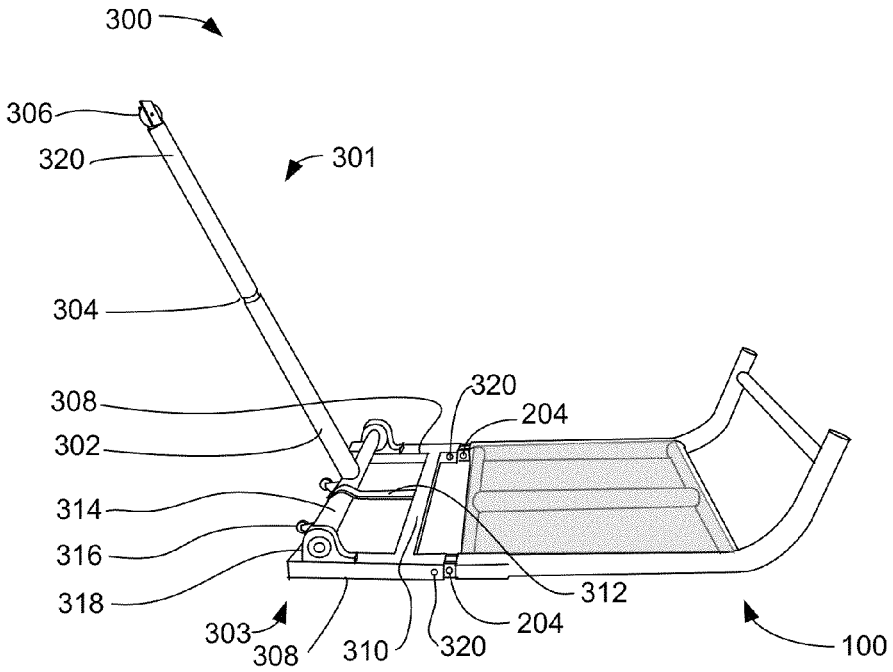
FIG. 3 is a high-side perspective view illustrating an exemplary embodiment of the sled of FIG. 1 attached to an exemplary adjustable pole support of the exemplary embodiment of the exercise equipment system, according to a preferred embodiment of the present invention.

FIG. 3 is a high-side perspective view illustrating an exemplary embodiment 300 of the sled 100 of FIG. 1 attached to an exemplary embodiment of an adjustable pole support 301 of the exemplary embodiment of the exercise equipment system, according to a preferred embodiment of the present invention. Adjustable pole support 301 has a frame 303 which includes opposed frame side members 308, main cross bar 310 connecting side members 308, and rear bar 504 (see FIG. 5) which also connects frame side members 308. Angular adjuster support 312 is supported by frame 303 and extends transversely between main cross bar 310 and rear bar 504 (see FIG. 5) at an off-center position. Bearings 318, which are preferably sleeve bearings, are supported on frame 303. In various alternate embodiments, other types of bearings may be used. Pole axle 314 is rotationally supported in bearings 318. Pole axle 314 is preferably pipe, and may be steel pipe. Pole 302 extends transversely from the middle of pole axle 314 and is rigidly fixed to pole axle 314. Pole 302 may have a telescoping joint 304 to provide additional length via telescoping section 320. The end of the last telescoping section 320 extending from pole 302, is a pulley 306. Multiple sections of pole, such as section 320 without the pulley 306, may be telescopically connected to further extend pole 302. Casters 316, mounted on frame 301, enable movement of the adjustable pole support 301 or the combination 300 of the sled 100 and the adjustable pole support 301 when the user forces the pole 302 downward to pry the device 300 or 301 up onto the wheels of casters 316.

Figure 4:
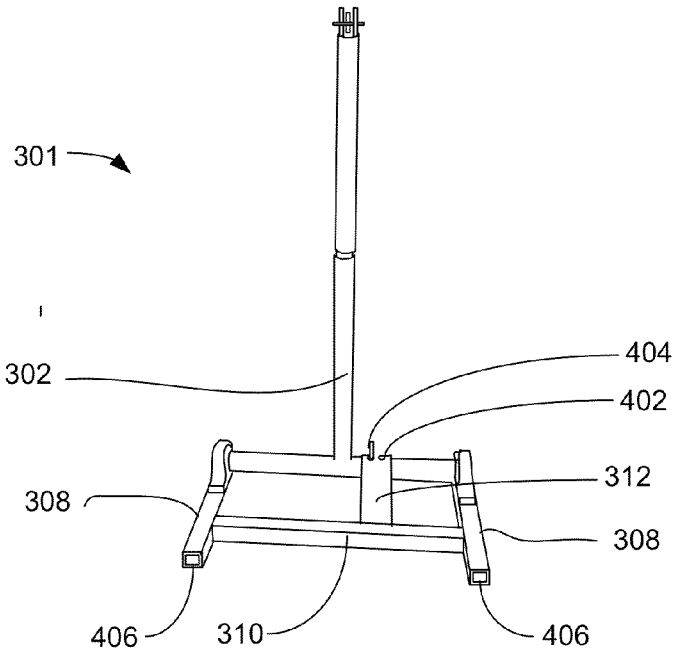
FIG. 4 is a high-side perspective view illustrating an exemplary embodiment of the adjustable pole support of FIG. 3 of the exemplary embodiment of the exercise equipment system, according to a preferred embodiment of the present invention.

FIG. 4 is a high-side perspective view illustrating an exemplary embodiment of the adjustable pole support 301 of FIG. 3 of the exemplary embodiment of the exercise equipment system, according to a preferred embodiment of the present invention. Frame side members 308 extend to be square attachment covers 406 for receivers 202 for releasably attaching adjustable pole support 301 to sled 100. Receivers 202 and covers 406 have alignable holes 204 and 320, respectively, through which fasteners, such as latchable pins, may be inserted to maintain connection. Angular adjuster 312 has holes 402 (one of two labeled) that may be discretely aligned with holes 602 (see FIG. 6) in pole axle 314 to receive and retain a releasable fastener 404, such as a pin 404, to maintain the angular position of pole 302 in place.

Figure 5:
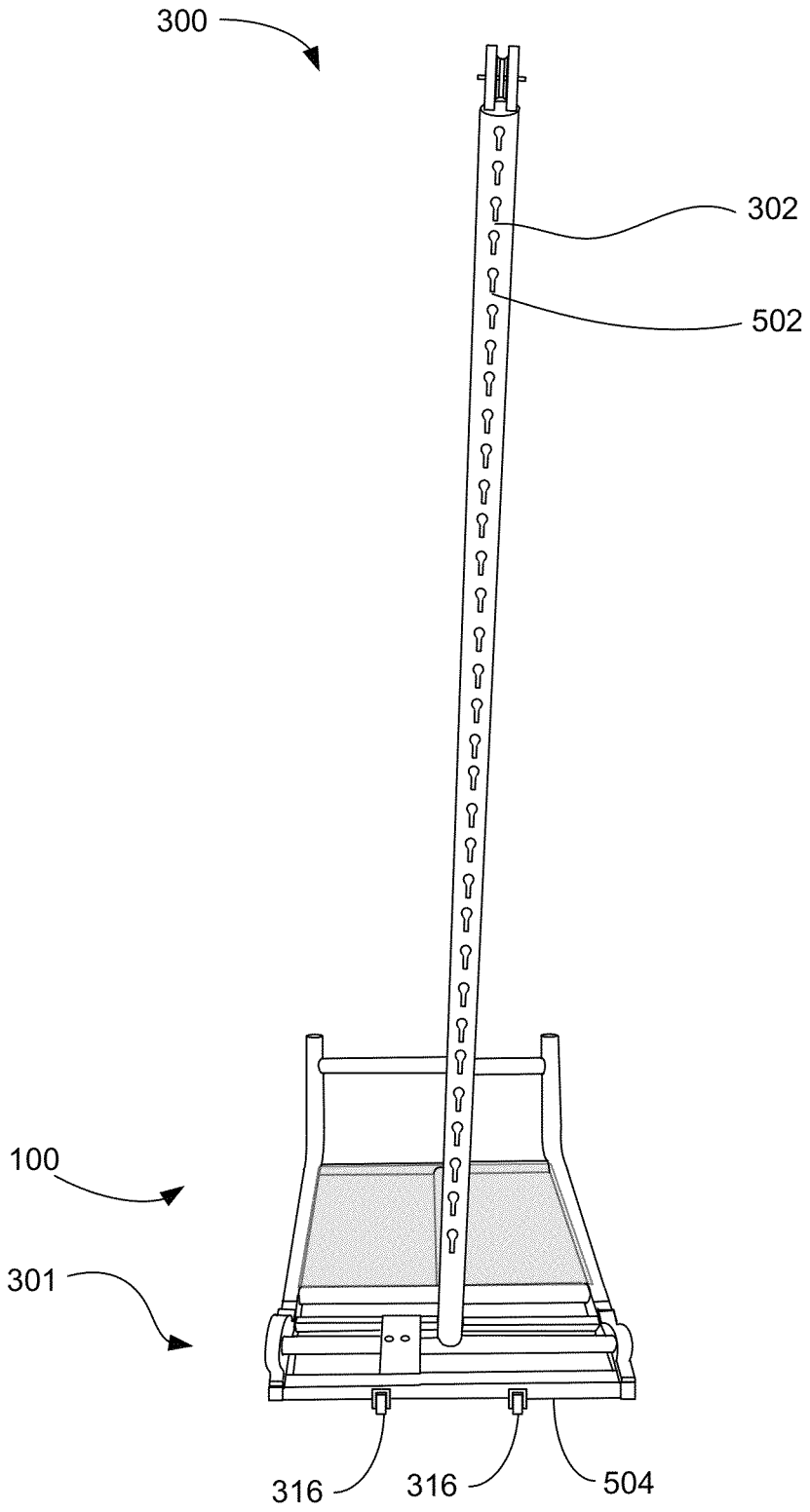
FIG. 5 is a high-rear perspective view illustrating an exemplary embodiment of the sled and adjustable pole support of FIG. 3 of the exemplary embodiment of the exercise equipment system, according to a preferred embodiment of the present invention.

FIG. 5 is a high-rear perspective view illustrating an exemplary embodiment of the sled 100 and adjustable pole support 301 of FIG. 3 of the exemplary embodiment of the exercise equipment system, according to a preferred embodiment of the present invention. One side of pole 302 has keyhole-shaped openings 502 (one of many labeled) for engaging collars 1402 (see FIG. 14), 1702 (See FIG. 17), 2102 (See FIGS. 21), and 4006 (see FIG. 40), which will be discussed in detail below. Rear bar 502 of frame 303 is visible in this view.

Figure 6:
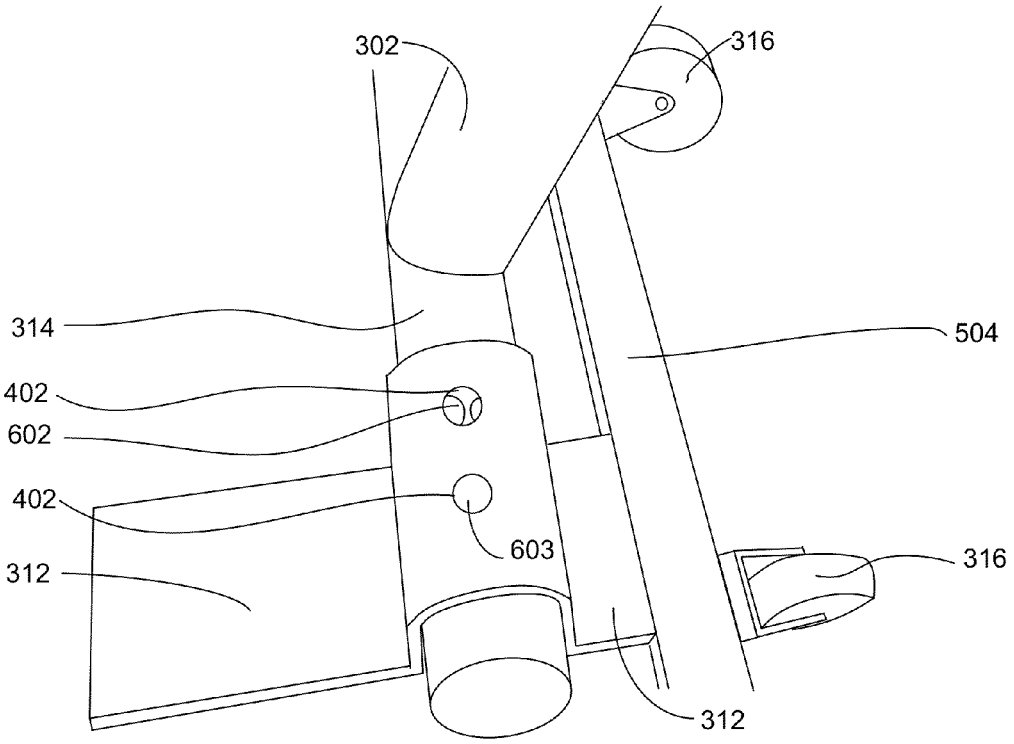
FIG. 6 is a top-side perspective partial view illustrating an exemplary embodiment of the sled and adjustable pole support of FIG. 3 of the exemplary embodiment of the exercise equipment system, according to a preferred embodiment of the present invention.

FIG. 6 is a top-side perspective partial view illustrating an exemplary embodiment of the sled 100 and adjustable pole support 301 of FIG. 3 of the exemplary embodiment of the exercise equipment system, according to a preferred embodiment of the present invention. Angular adjuster 402 is fixed to frame 303 on both sides of pole axle 314. Angular adjuster 402 has two openings 402 which are alignable to holes 602 and 603 in pole axle 314 for pinning the pole axle 312 in place. The semi-circumferential sequence of holes 603 are offset from the semi-circumferential sequence of holes 602, as shown, to allow pinning the pole axle 312 in place at half angles of the angular spacing of holes 602. Angular adjuster 402 is preferably steel, but other rigid materials may be used in various additional embodiments. A better view of rear bar 504 is shown, along with a better view of casters 316.

Figure 7:
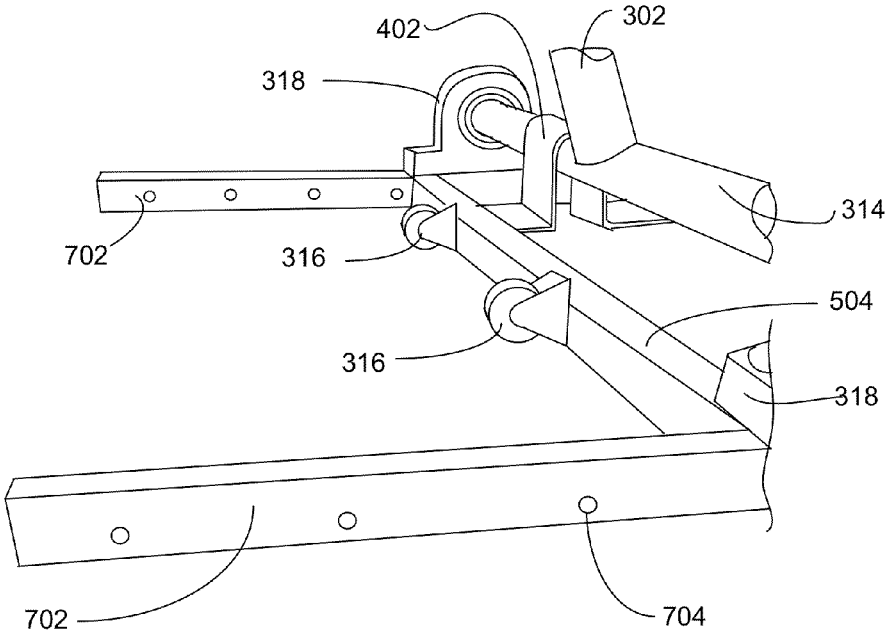
FIG. 7 is a high-side perspective partial view illustrating an exemplary embodiment of the adjustable pole support of FIG. 3 of the exemplary embodiment of the exercise equipment system, according to a preferred embodiment of the present invention.

FIG. 7 is a high-side perspective partial view illustrating an exemplary embodiment of the adjustable pole support 301 of FIG. 3 of the exemplary embodiment of the exercise equipment system, according to a preferred embodiment of the present invention. Adjustable pole support 301 has extendable stabilizers 702 with pinning holes 704 that extend out of frame side members 308 and can be pinned 802 (see FIG. 8) into alignable pinning holes 804 in frame side members 308. The extension desired can be determined by the user based on the angle of pole 302 and the load that pole 302 is bearing.

Figure 8:
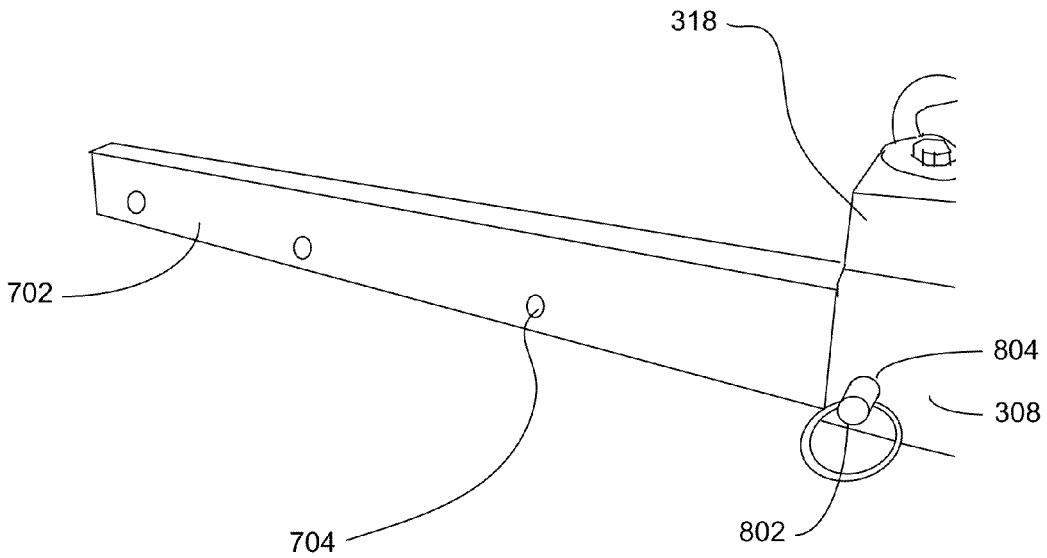
FIG. 8 is a front-side perspective view illustrating an exemplary embodiment of the adjustable stabilizers of the exemplary adjustable pole support of FIG. 3 of the exemplary embodiment of the exercise equipment system, according to a preferred embodiment of the present invention.

FIG. 8 is a front-side perspective view illustrating an exemplary embodiment of the adjustable stabilizers 702 of the exemplary adjustable pole support 301 of FIG. 3 of the exemplary embodiment of the exercise equipment system, according to a preferred embodiment of the present invention. Pin 802 extends through pinning hole 804 in side member 308 and into a stabilizer pinning hole 704 (not visible in this view) to secure stabilizer 702 in place. While pinning alignable holes is frequently illustrated in the exemplary embodiments, and is favored for cost reasons, other means of securing, such as clamps, other fasteners, or the like, may be used in additional embodiments.

Figure 9:
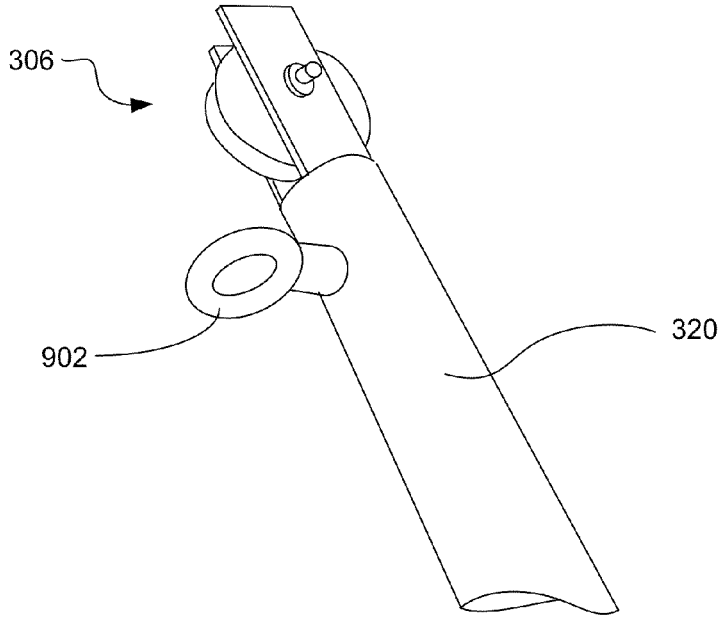
FIG. 9 is a low-side perspective view illustrating an exemplary embodiment of an adjustable pole top end of FIG. 3 of the exemplary embodiment of the exercise equipment system, according to a preferred embodiment of the present invention.

FIG. 9 is a low-side perspective view illustrating an exemplary embodiment of an adjustable pole section 320 top end 306 of FIG. 3 of the exemplary embodiment of the exercise equipment system, according to a preferred embodiment of the present invention. Pulley 306 is sized for cables that are strong enough to bear the loads anticipated for particular embodiments. Cable guide 902 may also be used for hanging particular attachments to pole section 320.

Figure 10:
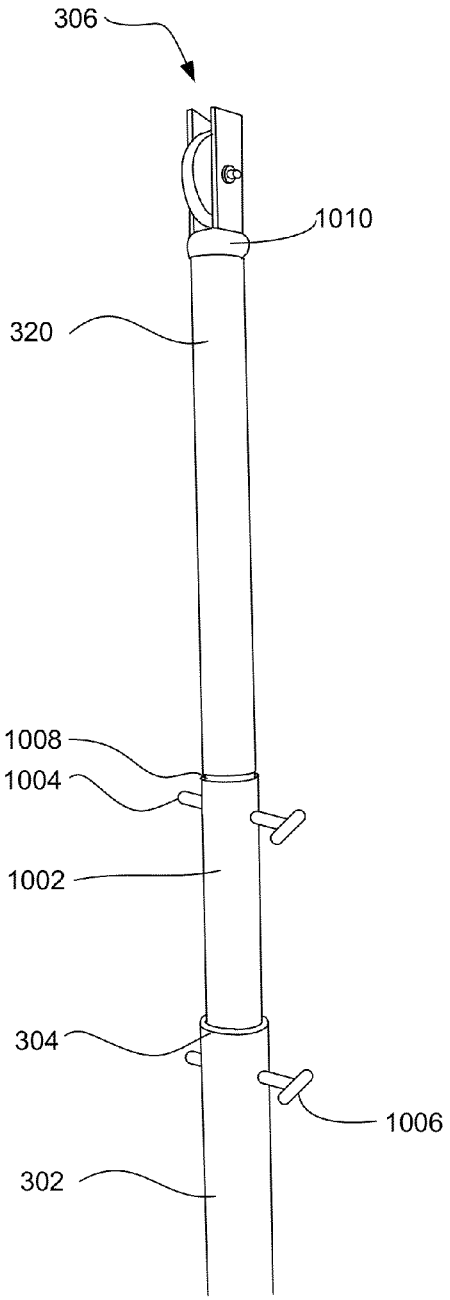
FIG. 10 is a side perspective view of the exemplary embodiment of adjustable pole of FIG. 3, of the exemplary embodiment of the exercise equipment system, according to a preferred embodiment of the present invention.

FIG. 10 is a side perspective view of the exemplary embodiment of adjustable pole 302 of FIG. 3, of the exemplary embodiment of the exercise equipment system, according to a preferred embodiment of the present invention. Pole 302 has a telescoping joint 304 that is secured by pin 1006 through alignable pinning holes in pole 302 and telescoping section 1002. Telescoping section 1002 extends to second telescoping joint 1008 which is similarly pinned by pin 1004 through alignable holes in section 1002 and second telescoping section 320. Second telescoping section 320 extends to pulley 306. Pulley 306 is shown with an optional swivel mount 1010.

Figure 11:
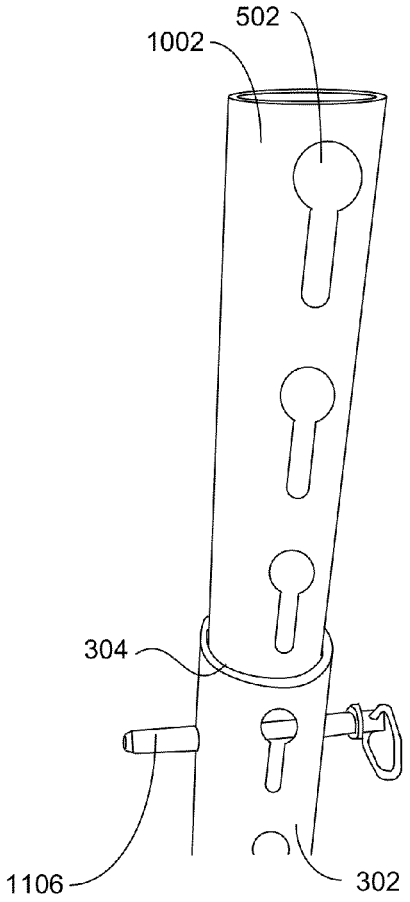
FIG. 11 is a side perspective view of the exemplary embodiment of adjustable pole of FIG. 3, of the exemplary embodiment of the exercise equipment system, according to a preferred embodiment of the present invention.

FIG. 11 is a side perspective view of the exemplary embodiment of adjustable pole 302, 320 of FIG. 3, of the exemplary embodiment of the exercise equipment system, according to a preferred embodiment of the present invention. Keyhole-shaped openings are better seen in this view, as is alternate pin 1106.

Figure 12:
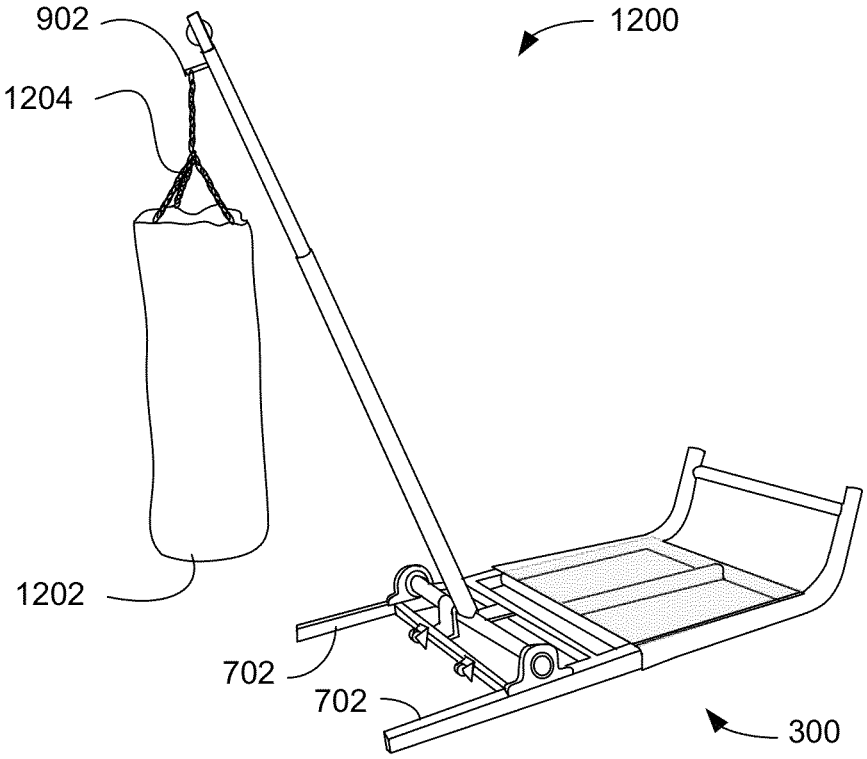
FIG. 12 is a rear-side perspective view of the exemplary embodiment of the sled and adjustable pole of FIG. 3 supporting an exemplary punching bag of the exemplary embodiment of the exercise equipment system, according to a preferred embodiment of the present invention.

FIG. 12 is a rear-side perspective view of the exemplary embodiment of the sled 100 and adjustable pole 302 of FIG. 3 supporting an exemplary punching bag 1202 of the exemplary embodiment of the exercise equipment system, according to a preferred embodiment of the present invention. Punching bag 1202 is suspended from ring 902 by chains 1204. Preferably, the bag is uniquely designed for kick-boxing. Other designs of punching bags 1202 may used in various alternate embodiments. Stabilizers 702 are shown deployed.

Figure 13:
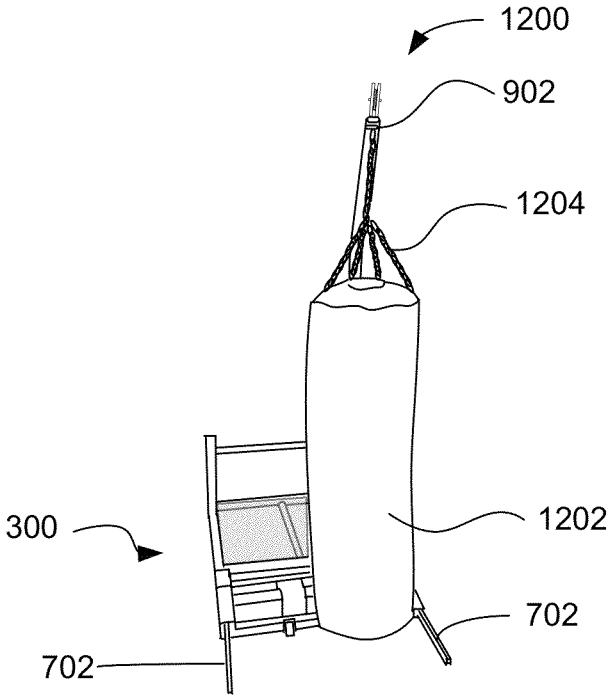
FIG. 13 is a rear perspective view of the exemplary embodiment of the sled and adjustable pole of FIG. 3 supporting an exemplary punching bag of the exemplary embodiment of the exercise equipment system, according to a preferred embodiment of the present invention.

FIG. 13 is a rear perspective view of the exemplary embodiment of the sled 100 and adjustable pole support 301 of FIG. 3 supporting an exemplary punching bag 1202 of the exemplary embodiment of the exercise equipment system, according to a preferred embodiment of the present invention. The angle of the pole 302 determines the height from which the punching bag 1202 can be hung. Stabilizers 702 are shown deployed. For particularly heavy punching bags 1202, weight may be added to the floor 116 of the sled 100 to counterbalance the punching bag 1202.

Figure 14:
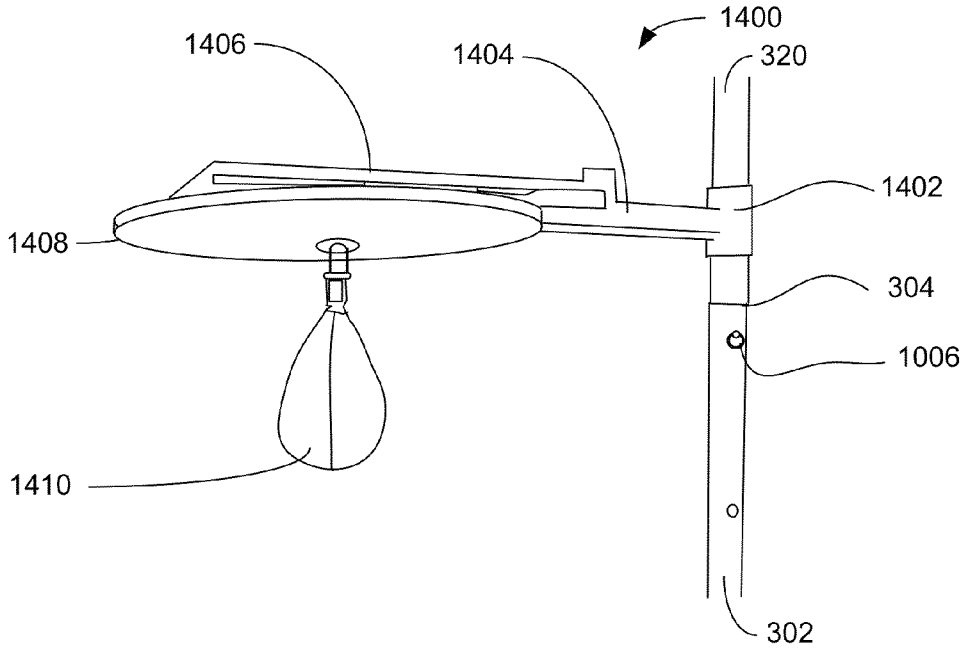
FIG. 14 is a right side perspective view of the exemplary embodiment of the exemplary adjustable pole of FIG. 3 supporting an exemplary speed bag of the exemplary embodiment of the exercise equipment system, according to a preferred embodiment of the present invention.

FIG. 14 is a right side perspective view of the exemplary embodiment of the exemplary adjustable pole 302 of FIG. 3 supporting an exemplary speed bag 1410 of the exemplary embodiment of the exercise equipment system, according to a preferred embodiment of the present invention. Pole 320 telescopes above pole 302 and is coupled to collar 1402 that is fixed to speed bag support bean 1404 that supports speed bag frame 1406. Speed bag deflector 1408 is secured to speed bag frame 1406 and supports speed bag 1410. Height is incrementally adjustable by telescoping the pole section 320 up or down, or by adjustment of the position of collar 1402.

Figure 15:
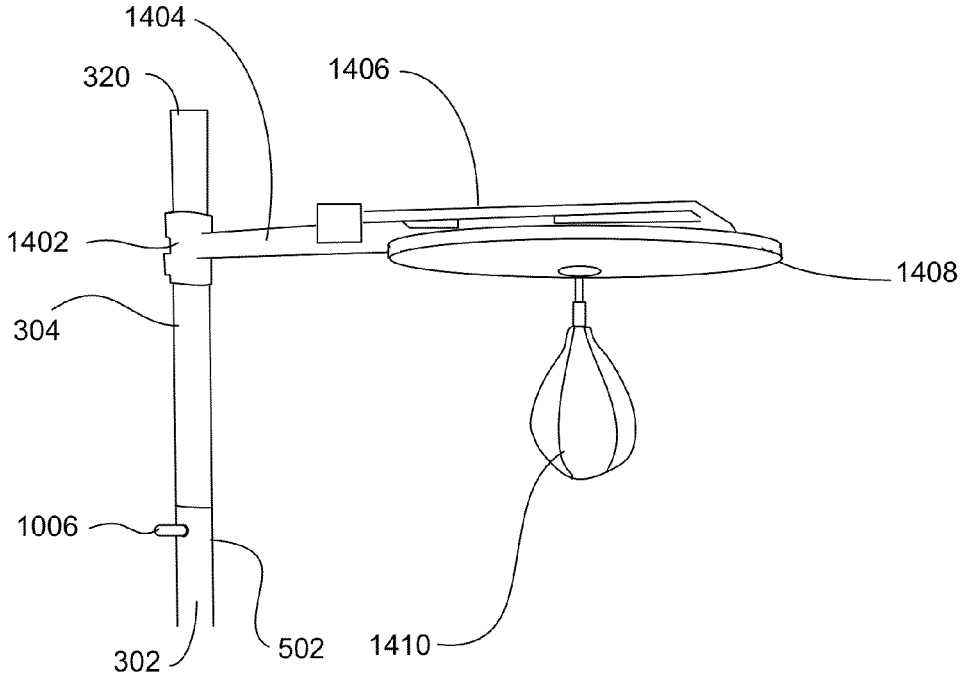
FIG. 15 is a left side perspective view of the exemplary embodiment of the exemplary adjustable pole of FIG. 3 supporting an exemplary speed bag of the exemplary embodiment of the exercise equipment system, according to a preferred embodiment of the present invention.

FIG. 15 is a left side perspective view of the exemplary embodiment of the exemplary adjustable pole 320 of FIG. 3 supporting an exemplary speed bag 1410 of the exemplary embodiment of the exercise equipment system, according to a preferred embodiment of the present invention.

Figure 16:
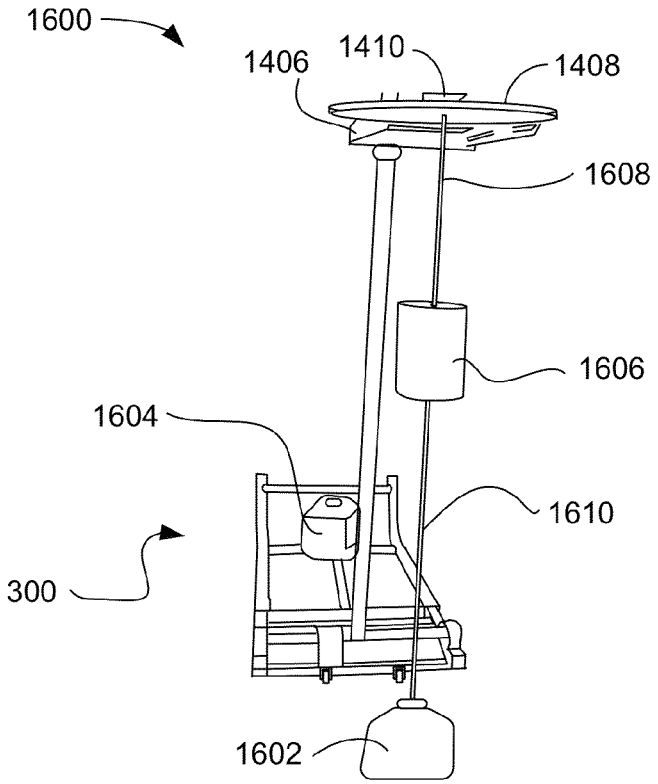
FIG. 16 is a rear perspective view of the exemplary embodiment of the exemplary sled and adjustable pole support of FIG. 3 supporting an exemplary bob-and-weave bag of the exemplary embodiment of the exercise equipment system, according to a preferred embodiment of the present invention.

FIG. 16 is a rear perspective view of the exemplary embodiment of the exemplary sled 100 and adjustable pole support 301 of FIG. 3 supporting an exemplary bob-and-weave bag 1606 of the exemplary embodiment of the exercise equipment system, according to a preferred embodiment of the present invention. To set up the bob-and-weave bag 1606, the speed bag frame 1406 is turned upside down. Collar 1402 works right-side-up or upside-down, which facilitated the reversal. Bob-and-weave bag 1606 is suspended from speed bag frame 1406 by upper cord 1608 and is anchored to weight container 1602 by lower cord 1610. Weight container 1604 on sled 100 assists in counterbalancing the load on pole 302. Weight containers 1602 and 1604 are preferably releasably closable water jugs having a volume of two-and-one-half-gallons or more.

Figure 17:
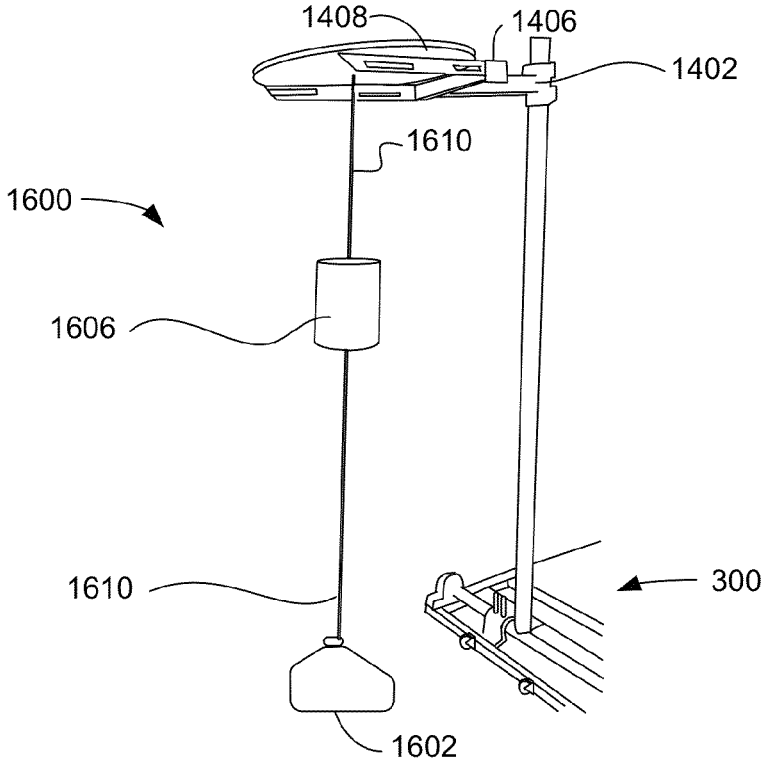
FIG. 17 is a rear-side perspective view of the exemplary embodiment of the exemplary sled and adjustable pole support of FIG. 3 supporting an exemplary bob-and-weave bag of the exemplary embodiment of the exercise equipment system, according to a preferred embodiment of the present invention.

FIG. 17 is a rear-side perspective view of the exemplary embodiment of the exemplary sled 100 and adjustable pole support 301 of FIG. 3 supporting an exemplary bob-and-weave bag 1606 of the exemplary embodiment of the exercise equipment system, according to a preferred embodiment of the present invention.

Figure 18:
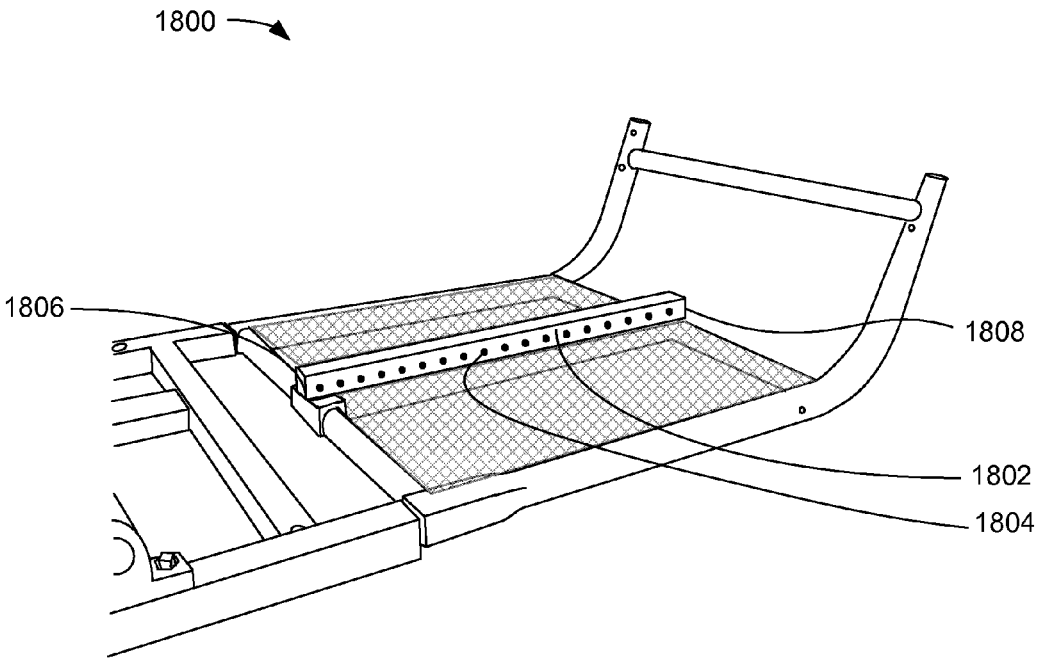
FIG. 18 is a rear-side perspective view of the exemplary embodiment of the exemplary sled and adjustable pole support of FIG. 3 and exemplary central attachment bar of the exemplary embodiment of the exercise equipment system, shown in an operational environment, according to a preferred embodiment of the present invention.

FIG. 18 is a rear-side perspective view of the exemplary embodiment of the exemplary sled 100 and adjustable pole support 301 of FIG. 3 and exemplary central attachment bar 1802 of the exemplary embodiment of the exercise equipment system, shown in an operational environment, according to a preferred embodiment of the present invention. Central attachment bar 1802 has pinning holes 1804 and is attached at front and rear ends 1806 and 1809 to the front cross bar 112 and the rear cross bar 124, respectively. Central attachment bar 1802 serves as a mounting for additional equipment, as will be discussed further below.

Figure 19:
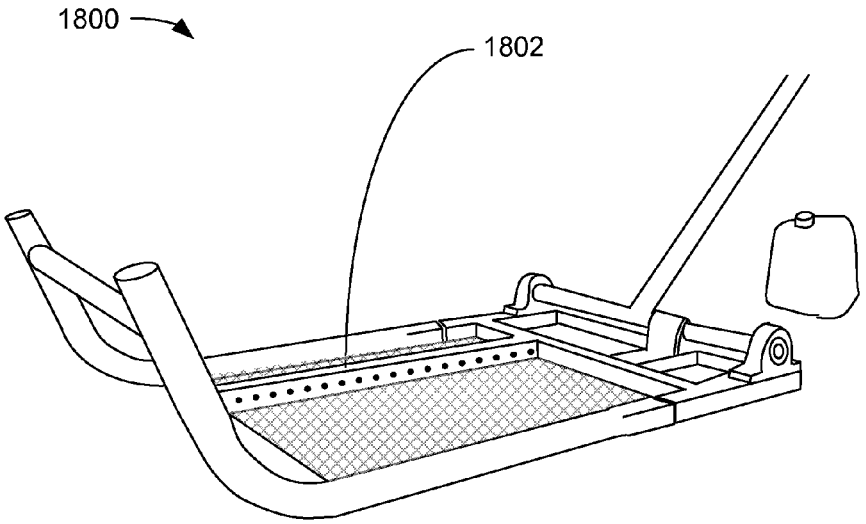
FIG. 19 is a front-side perspective view of the exemplary embodiment of the exemplary sled and adjustable pole support of FIG. 3 and exemplary central attachment bar of the exemplary embodiment of the exercise equipment system, shown in an operational environment, according to a preferred embodiment of the present invention.

FIG. 19 is a front-side perspective view of the exemplary embodiment of the exemplary sled 100 and adjustable pole support 301 of FIG. 3 and exemplary central attachment bar 1802 of the exemplary embodiment of the exercise equipment system, shown in an operational environment, according to a preferred embodiment of the present invention. Central attachment bar 1802 is parallel to and aligned with central support 118.

Figure 20:
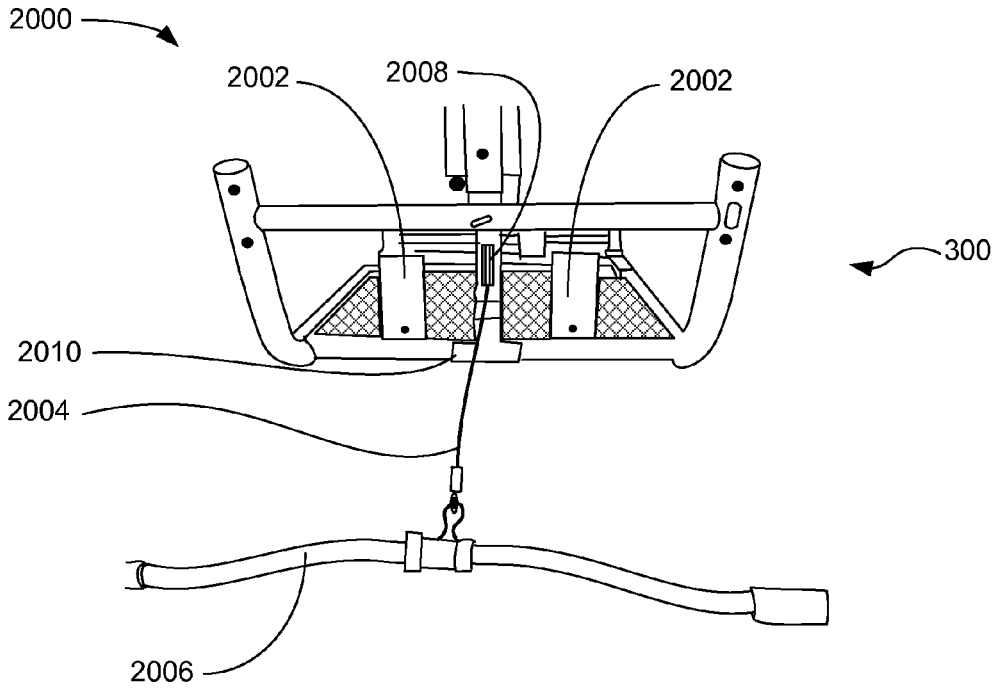
FIG. 20 is a front perspective view of the exemplary embodiment of the exemplary sled and adjustable pole support of FIG. 3 and exemplary central attachment bar of FIG. 18 of the exemplary embodiment of the exercise equipment system, shown in an operational environment, according to a preferred embodiment of the present invention.

FIG. 20 is a front perspective view of the exemplary embodiment of the exemplary sled 100 and adjustable pole support 301 of FIG. 3 and exemplary central attachment bar 1802 of FIG. 18 of the exemplary embodiment of the exercise equipment system, according to a preferred embodiment of the present invention. Cable 2004 flexibly links pull handle 2006 to a weight container (not visible in this view) via pulley 2008 mounted on central attachment bar 1802, further via an additional pulley 2104 (see FIG. 21) on pole 302 (see FIG. 21) and pulley 306. Foot supports 2002, attached to front dross bar 112, enable the user to support his feet while sitting on the ground and pulling against weight on handle 2006. Attachment plate 2010, which couples to front cross bar 112 via holes 114 and to central attachment bar 1802 via welding, fastening, or the like, secures central attachment bar 1802 to sled 100.

Figure 21:
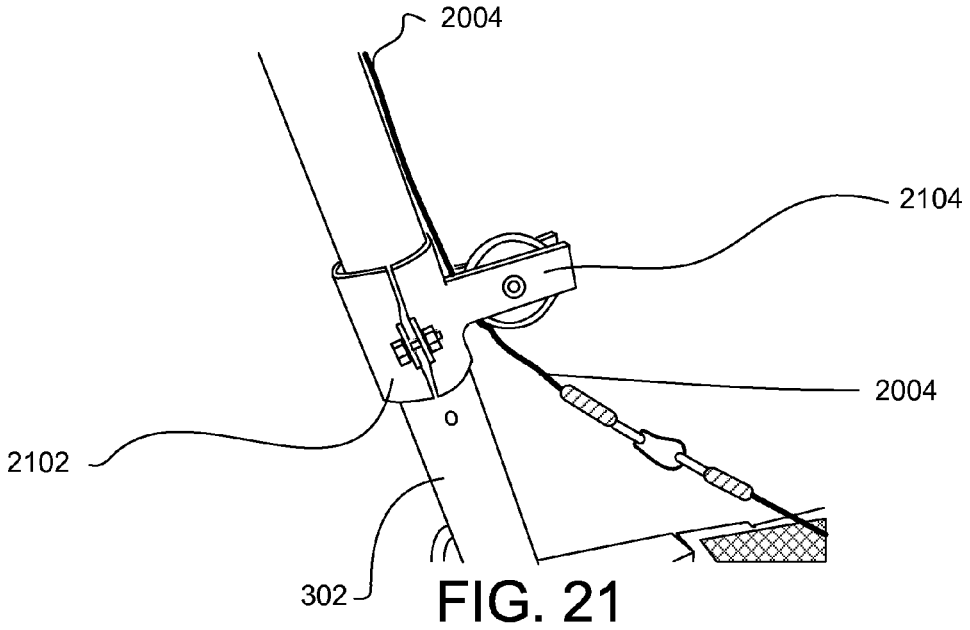
FIG. 21 is a rear-side perspective view of the exemplary embodiment of the exemplary adjustable pole of FIG. 3 and exemplary collar-attached pulley, coupled to the adjustable pole of FIG. 3, of the exemplary embodiment of the exercise equipment system, shown in an operational environment, according to a preferred embodiment of the present invention.

FIG. 21 is a rear-side perspective view of the exemplary embodiment of the exemplary adjustable pole 302 of FIG. 3 and exemplary collar-attached pulley 2104, coupled to the adjustable pole 302 of FIG. 3, of the exemplary embodiment of the exercise equipment system, shown in an operational environment, according to a preferred embodiment of the present invention. Collar 2102 attaches pulley to pole 302 via internal large-headed pins 4508 (see FIG. 45) engaging keyhole-shaped openings 502. Cable 2004 feeds through pulley 2104, up to and through pulley 306 and then down to weights, such as weight canisters 1602.

Figure 22:
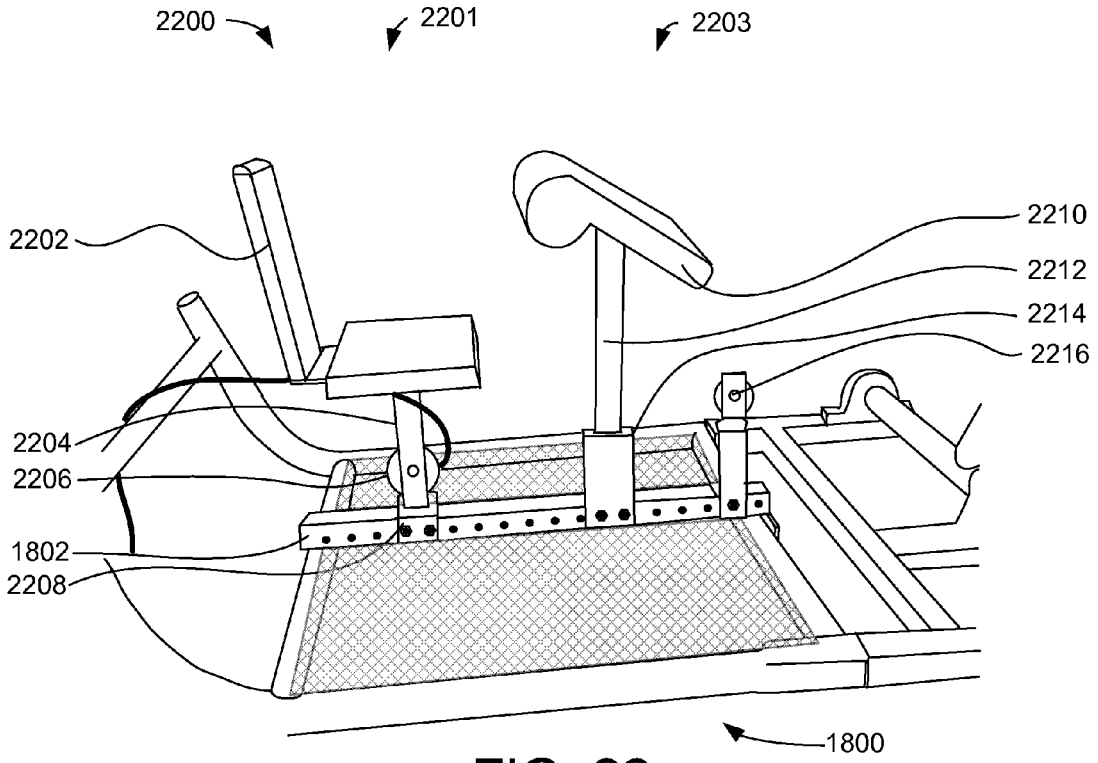
FIG. 22 is a side perspective view of the exemplary embodiment of the exemplary sled and adjustable pole support of FIG. 3 and exemplary central attachment bar of FIG. 18, with exemplary embodiments of attachments thereto, of the exemplary embodiment of the exercise equipment system, shown in an operational environment, according to a preferred embodiment of the present invention.

FIG. 22 is a side perspective view of the exemplary embodiment of the exemplary sled 100 and adjustable pole support 301 of FIG. 3 and exemplary central attachment bar 1802 of FIG. 18, with exemplary embodiments of attachments 2210 and 2203 thereto, of the exemplary embodiment of the exercise equipment system, shown in an operational environment, according to a preferred embodiment of the present invention. Chair 2201 is supported by pedestal 2204. Pedestal 2204 is attached to central attachment bar 1802 via pedestal attachment flanges 2208 with double pinning holes. Upper arm support 2210 is supported by curl pedestal 2212 on curl pedestal attachment flange 2214. Pedestal pulley 2216 also attaches to the central attachment bar 1802. The cable threads through pedestal pulley 2216 to pulley 2104 (see FIG. 21) and to pulley 306 before attaching to weight canister 1602. Under-seat pulley 2206 is not used in this configuration.

Figure 23:
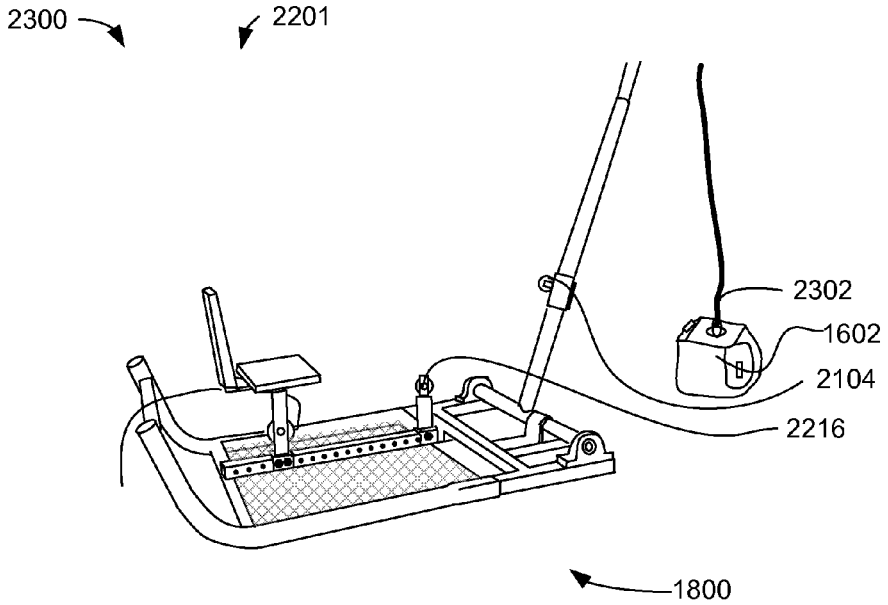
FIG. 23 is a front-side perspective view of the exemplary embodiment of the exemplary sled and adjustable pole support of FIG. 3 and exemplary central attachment bar of FIG. 18, with exemplary embodiments of attachments thereto, of the exemplary embodiment of the exercise equipment system, shown in an operational environment, according to a preferred embodiment of the present invention.

FIG. 23 is a front-side perspective view of the exemplary embodiment of the exemplary sled 100 and adjustable pole support 301 of FIG. 3 and exemplary central attachment bar 1802 of FIG. 18, with exemplary embodiments of attachments 2201 and 2216 thereto, of the exemplary embodiment of the exercise equipment system, shown in an operational environment, according to a preferred embodiment of the present invention. The cable 2302 threads through pedestal pulley 2216 to pulley 2104 and to pulley 306 before attaching to weight canister 1602. The user exerts force on an attachment near the end of the cable 2302 near the chair 2202 to lift weight canister 1602 for exercise.

Figure 24:
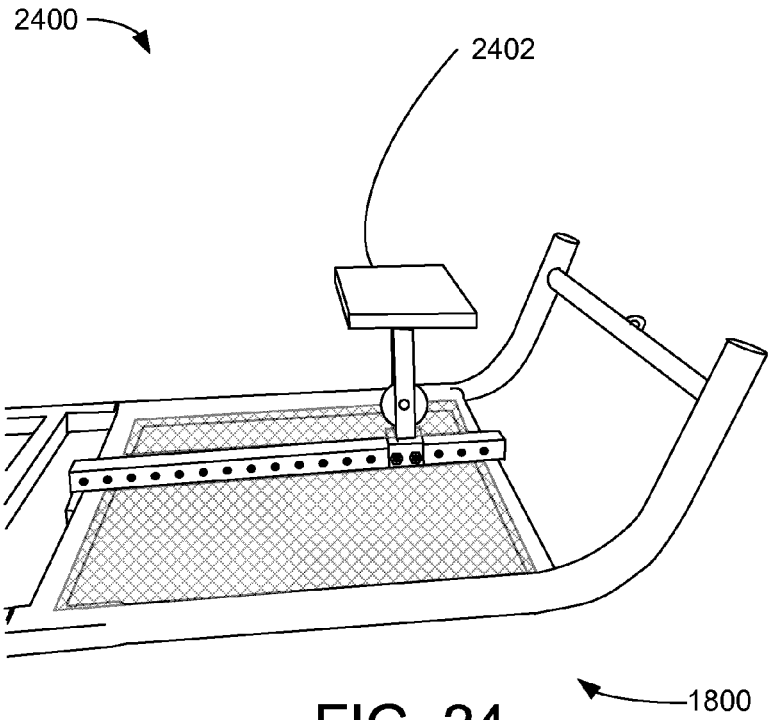
FIG. 24 is a high-side perspective view of the exemplary embodiment of the exemplary sled and adjustable pole support of FIG. 3 and exemplary central attachment bar of FIG. 18, with an exemplary embodiment of an attachment thereto, of the exemplary embodiment of the exercise equipment system, shown in an operational environment, according to a preferred embodiment of the present invention.

FIG. 24 is a high-side perspective view of the exemplary embodiment of the exemplary sled 100 and adjustable pole support 302 of FIG. 3 and exemplary central attachment bar 1802 of FIG. 18, with an exemplary embodiment of an attachment 2402 thereto, of the exemplary embodiment of the exercise equipment system, shown in an operational environment, according to a preferred embodiment of the present invention. The coach can sit in the pedestal bench seat 2402 while the athletes push or pull the sled 100.

Figure 25:
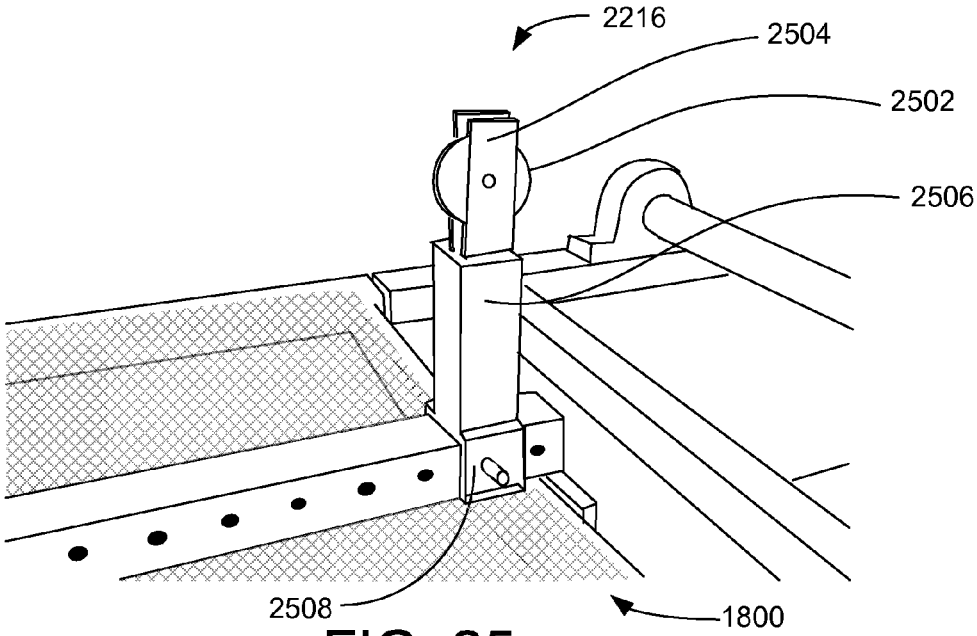
FIG. 25 is a front-side perspective view of the exemplary embodiment of the exemplary sled and adjustable pole support of FIG. 3 and exemplary central attachment bar of FIG. 18, with an exemplary embodiment of an attachment thereto, of the exemplary embodiment of the exercise equipment system, shown in an operational environment, according to a preferred embodiment of the present invention.

FIG. 25 is a front-side perspective view of the exemplary embodiment of the exemplary sled 100 and adjustable pole support 301 of FIG. 3 and exemplary central attachment bar of FIG. 18, with an exemplary embodiment of an attachment 2216 thereto, of the exemplary embodiment of the exercise equipment system, shown in an operational environment, according to a preferred embodiment of the present invention. A closer look at pedestal pulley 2216 reveals a pulley support 2504 supporting pulley 2502 and supported by pedestal 2506 that is pinned 2508 to the central attachment bar 1802. Pedestal pulley 2216 is exemplary, and various configurations for pulleys 2502 and pulley supports 2504 are within the scope of the invention.

Figure 26:
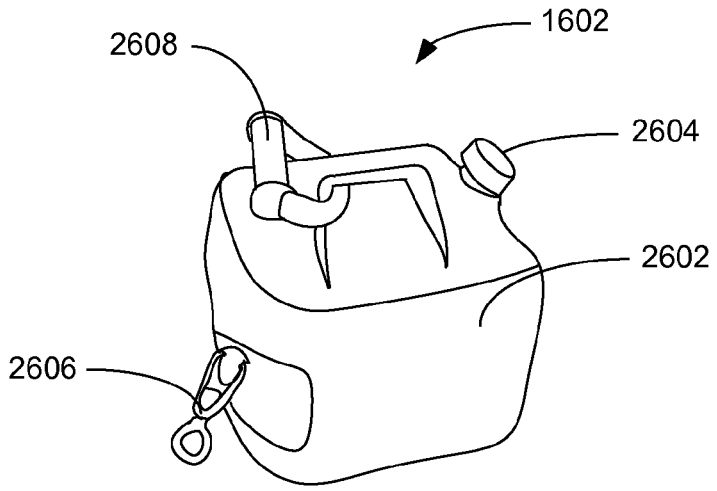
FIG. 26 is a rear-side perspective view of the exemplary embodiment of the exemplary weight container of FIG. 16, with exemplary embodiments of attachments thereto, of the exemplary embodiment of the exercise equipment system, shown in an operational environment, according to a preferred embodiment of the present invention.

FIG. 26 is a rear-side perspective view of the exemplary embodiment of the exemplary weight container 1602 of FIG. 16, with exemplary embodiments of attachments 2604, 2606, and 2608, thereto, of the exemplary embodiment of the exercise equipment system, according to a preferred embodiment of the present invention. The container body 2602 preferably contains water and is marked on the exterior to show weight as a function of volume. While water is preferred, other contents may be used for weight in various additional embodiments. Container body 2602 has a releasable fill cap 2604. Cable attachment 2606 assists in attaching the weight container 1602 to a cable, such as cable 2004. Manual handle 2608 enables easy grasping and lifting with some twist flexibility for "chainsaw" exercises.

Figure 27:
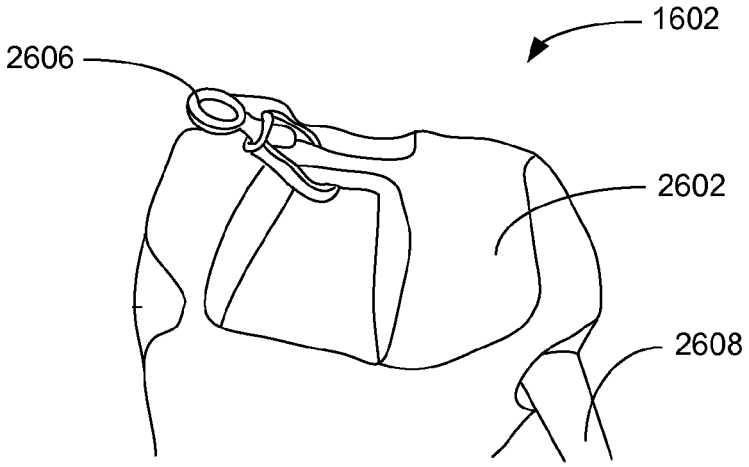
FIG. 27 is a rear perspective view of the exemplary embodiment of the exemplary weight container of FIG. 16, with exemplary embodiments of attachments thereto, of the exemplary embodiment of the exercise equipment system, shown in an operational environment, according to a preferred embodiment of the present invention.

FIG. 27 is a rear perspective view of the exemplary embodiment of the exemplary weight container 1602 of FIG. 16, with exemplary embodiments of attachments 2606 and 2608 thereto, of the exemplary embodiment of the exercise equipment system, shown in an operational environment, according to a preferred embodiment of the present invention. An improved view of attachment 2606 is provided. Various sizes and shapes of weight containers 1602 are within the scope of the present invention.

Figure 28:
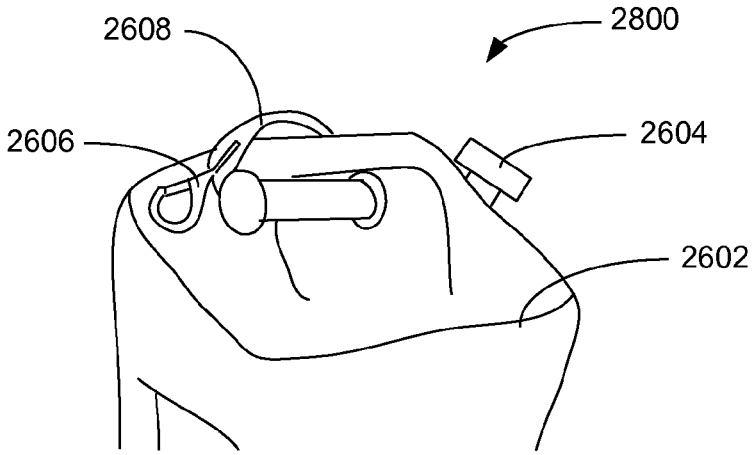
FIG. 28 is a rear-side perspective view of the exemplary embodiment of the exemplary weight container, with exemplary embodiments of attachments thereto, of the exemplary embodiment of the exercise equipment system, shown in an operational environment, according to a preferred embodiment of the present invention.

FIG. 28 is a rear-side perspective view of the exemplary embodiment of the exemplary weight container 1602, with exemplary embodiments of attachments 2606 and 2608 attached thereto, of the exemplary embodiment of the exercise equipment system, shown in an operational environment, according to a preferred embodiment of the present invention. Here, cable attachment 2606 is attached to manual handle 2608. Various shapes and sizes of weight containers 1602 may be used in various additional embodiments.

Figure 29:
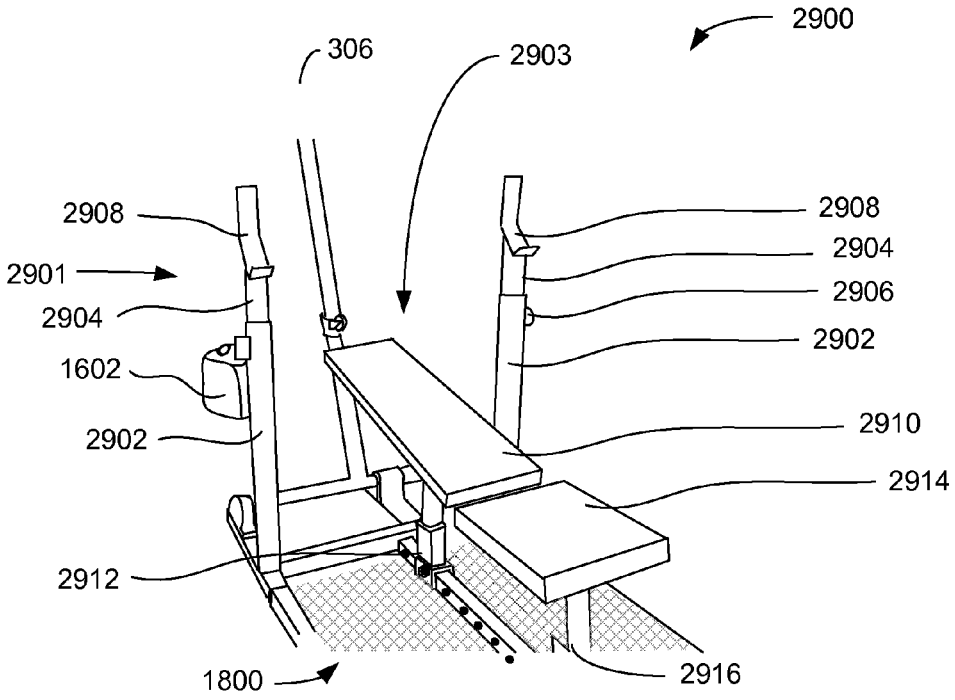
FIG. 29 is a front-side perspective view of the exemplary embodiment of the exemplary sled and adjustable pole support of FIG. 3 and exemplary central attachment bar of FIG. 18, with exemplary embodiments of attachments thereto, of the exemplary embodiment of the exercise equipment system, shown in an operational environment, according to a preferred embodiment of the present invention.

FIG. 29 is a front-side perspective view of the exemplary embodiment of the exemplary sled 100 and adjustable pole support 301 of FIG. 3 and exemplary central attachment bar 1802 of FIG. 18, with exemplary embodiments of attachments 2901 and 2903 thereto, of the exemplary embodiment of the exercise equipment system, shown in an operational environment, according to a preferred embodiment of the present invention. Attachment 2901 is a bench press support rack 2901 comprising two opposed vertical posts 2902 pinned to frame side members 308 and telescopically engaging and supporting adjustable rack supports 2904 that have racks 2908 to engage a lifting bar. Spring-biased captive pin 2906 is used to secure the adjustable rack supports at the desired height. Inclinable bench 2903 has an inclinable portion 2910 and a seat portion 2914, both resting on pedestals 2912 and 2916 jointly.

Figure 30:
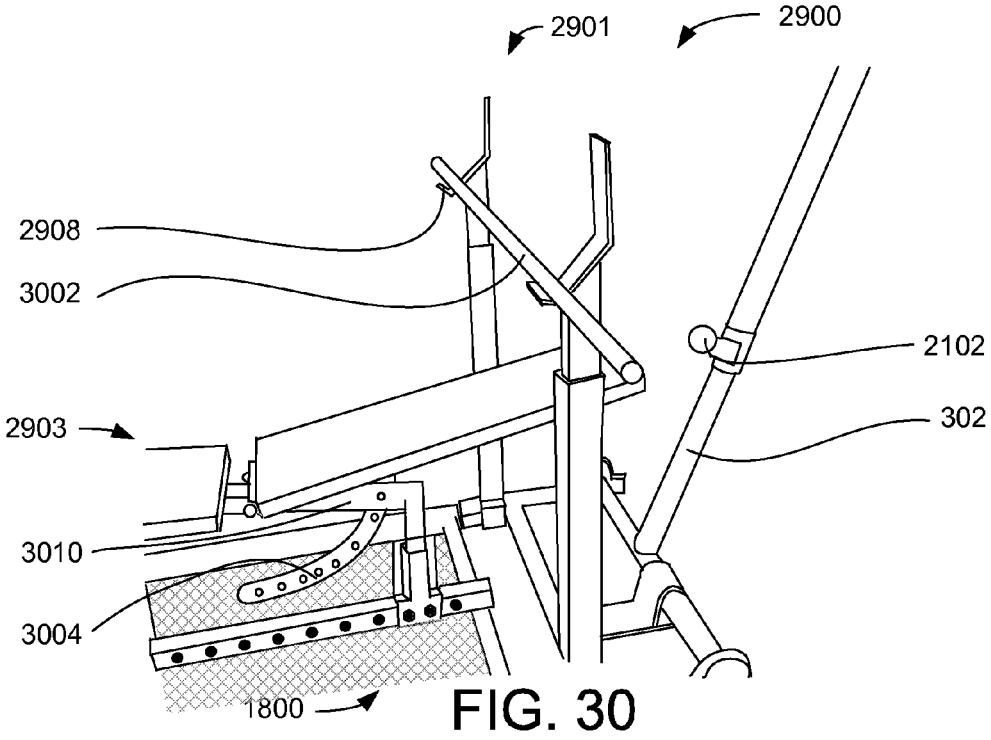
FIG. 30 is a front-side perspective view of the exemplary embodiment of the exemplary sled and adjustable pole support of FIG. 3 and exemplary central attachment bar of FIG. 18, with exemplary embodiments of attachments thereto of FIG. 29, of the exemplary embodiment of the exercise equipment system, shown in an operational environment, according to a preferred embodiment of the present invention.

FIG. 30 is a front-side perspective view of the exemplary embodiment of the exemplary sled 100 and adjustable pole support 301 of FIG. 3 and exemplary central attachment bar 1802 of FIG. 18, with exemplary embodiments of attachments 2901 and 2903 thereto of FIG. 29, of the exemplary embodiment of the exercise equipment system, shown in an operational environment, according to a preferred embodiment of the present invention. Beam 3010 connects pedestals 2912 and 2916 to support inclined portion 2910 and seat portion 2914 of inclinable bench 2903. Incline arch 3004 enables discrete choices in the degree of incline of inclined portion 2910. Weight bar 3002 rests in racks 2908.

Figure 31:
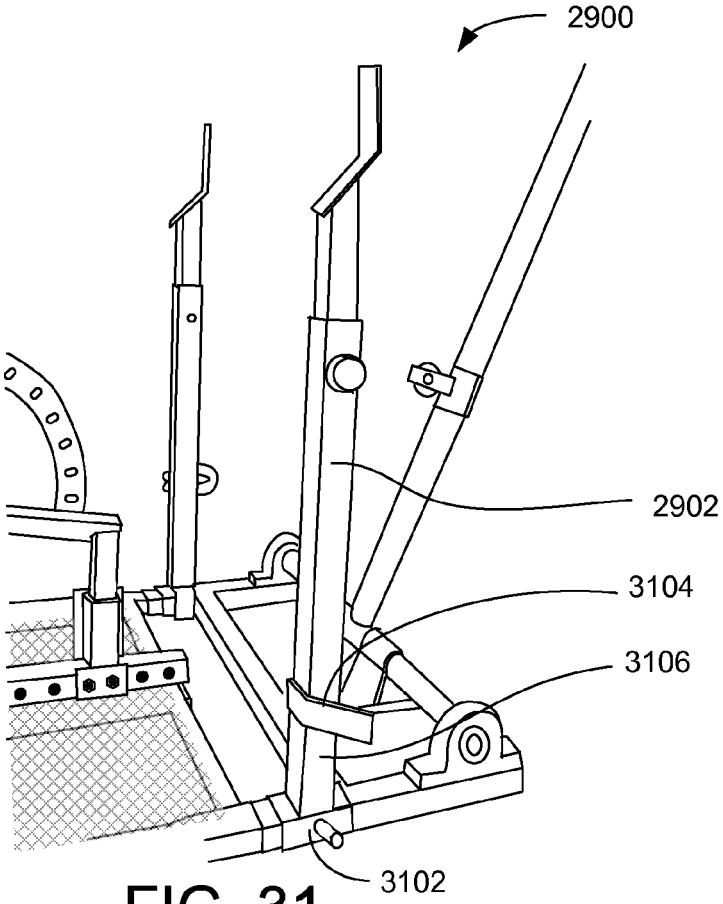
FIG. 31 is a front-side perspective partial view of the exemplary embodiment of the exemplary sled and adjustable pole support of FIG. 3 and exemplary central attachment bar of FIG. 18, with exemplary embodiments of attachments thereto of FIG. 29, of the exemplary embodiment of the exercise equipment system, shown in an operational environment, according to a preferred embodiment of the present invention.

FIG. 31 is a front-side perspective partial view of the exemplary embodiment of the exemplary sled 100 and adjustable pole support 301 of FIG. 3 and exemplary central attachment bar 1802 of FIG. 18, with exemplary embodiments of attachments 2901 and 2903 thereto of FIG. 29, of the exemplary embodiment of the exercise equipment system, shown in an operational environment, according to a preferred embodiment of the present invention. In a particular embodiment, post 2902 may be secured in a socket 3106 via a pin 3104, where the socket 3106 is attached to frame side members 308.

Figure 32:
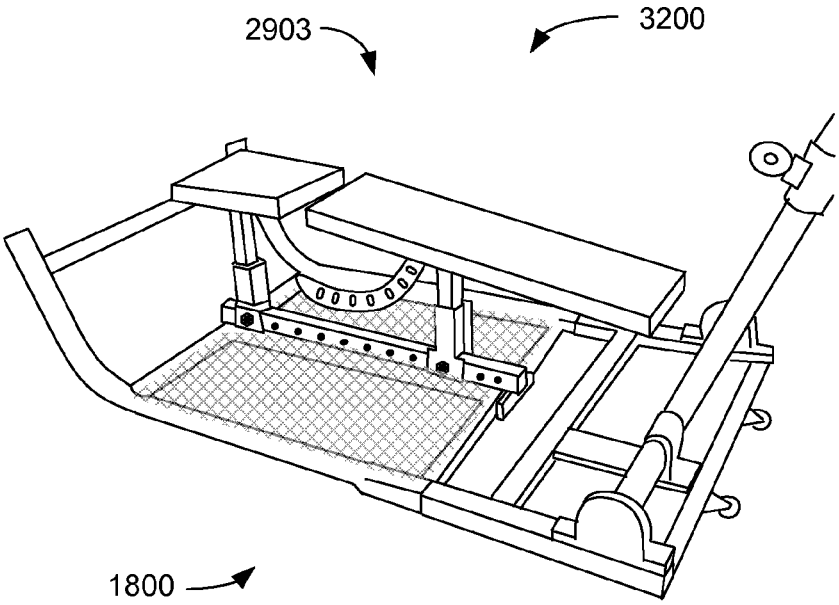
FIG. 32 is a rear-side perspective partial view of the exemplary embodiment of the exemplary sled and adjustable pole support of FIG. 3 and exemplary central attachment bar of FIG. 18, with an exemplary embodiment of an attachment thereto of FIG. 29, of the exemplary embodiment of the exercise equipment system, shown in an operational environment, according to a preferred embodiment of the present invention.

FIG. 32 is a rear-side perspective partial view of the exemplary embodiment of the exemplary sled 100 and adjustable pole support 302 of FIG. 3 and exemplary central attachment bar 1802 of FIG. 18, with an exemplary embodiment of an attachment 2903 thereto of FIG. 29, of the exemplary embodiment of the exercise equipment system, shown in an operational environment, according to a preferred embodiment of the present invention. Inclined bench 2903 is shown without the bench press support rack 2901.

Figure 33:
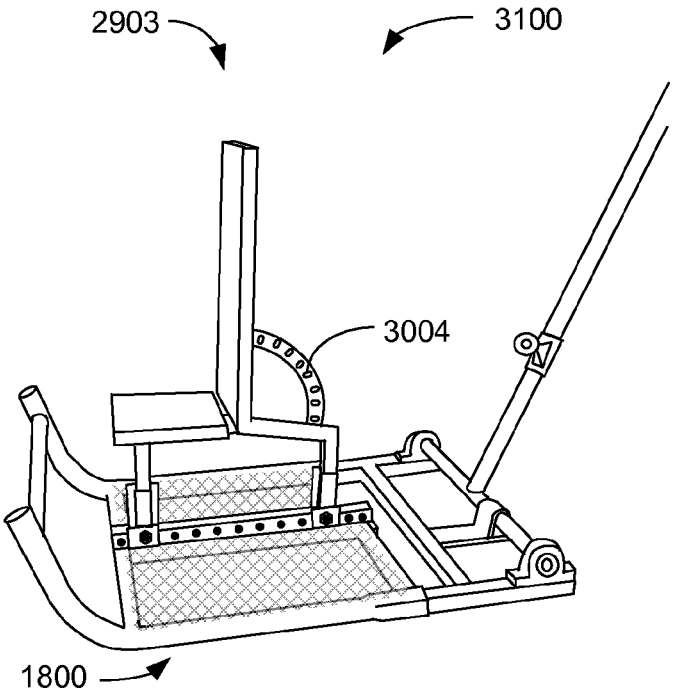
FIG. 33 is a side perspective partial view of the exemplary embodiment of the exemplary sled and adjustable pole support of FIG. 3 and exemplary central attachment bar of FIG. 18, with an exemplary embodiment of an attachment thereto of FIG. 29, of the exemplary embodiment of the exercise equipment system, shown in an operational environment, according to a preferred embodiment of the present invention.

FIG. 33 is a side perspective partial view of the exemplary embodiment of the exemplary sled 100 and adjustable pole support 302 of FIG. 3 and exemplary central attachment bar 1802 of FIG. 18, with an exemplary embodiment of an attachment 2903 thereto of FIG. 29, of the exemplary embodiment of the exercise equipment system, shown in an operational environment, according to a preferred embodiment of the present invention. Inclined bench 2903 is shown in its fully upright position.

Figure 34:
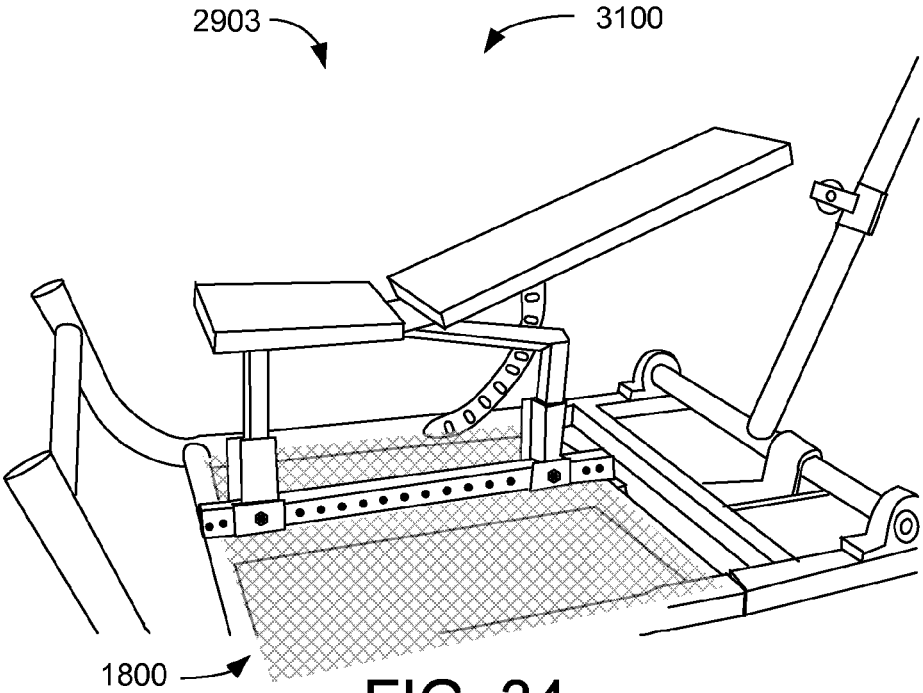
FIG. 34 is a side perspective partial view of the exemplary embodiment of the exemplary sled and adjustable pole support of FIG. 3 and exemplary central attachment bar of FIG. 18, with an exemplary embodiment of an attachment thereto of FIG. 29, of the exemplary embodiment of the exercise equipment system, shown in an operational environment, according to a preferred embodiment of the present invention.

FIG. 34 is a side perspective partial view of the exemplary embodiment of the exemplary sled 100 and adjustable pole support 302 of FIG. 3 and exemplary central attachment bar 1802 of FIG. 18, with an exemplary embodiment of an attachment 2903 thereto of FIG. 29, of the exemplary embodiment of the exercise equipment system, shown in an operational environment, according to a preferred embodiment of the present invention. Inclined bench 2903 is shown in a partially upright position.

Figure 35:
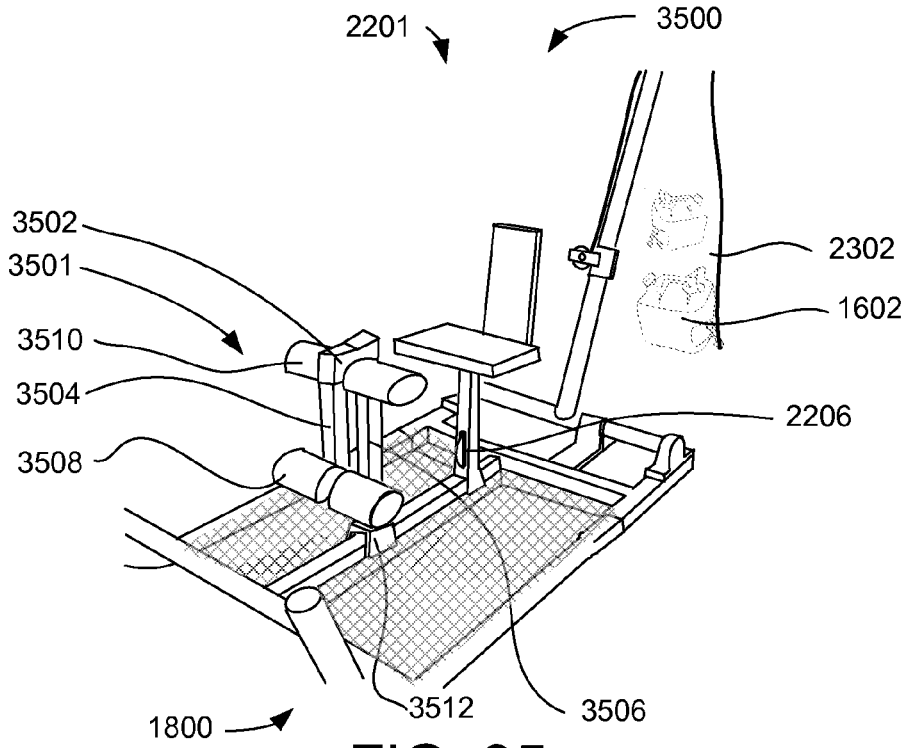
FIG. 35 is a front-side perspective partial view of the exemplary embodiment of the exemplary sled and adjustable pole support of FIG. 3 and exemplary central attachment bar of FIG. 18, with exemplary embodiments of attachments thereto, of the exemplary embodiment of the exercise equipment system, shown in an operational environment, according to a preferred embodiment of the present invention.

FIG. 35 is a front-side perspective partial view of the exemplary embodiment of the exemplary sled 100 and adjustable pole support 301 of FIG. 3 and exemplary central attachment bar 1802 of FIG. 18, with exemplary embodiments of attachments 2201 and 3501 thereto, of the exemplary embodiment of the exercise equipment system, shown in an operational environment, according to a preferred embodiment of the present invention. Leg extension attachment 3501 has a pedestal 3512 supporting a pillar 3506 that supports a pivot 3502. Pillar 3506 also supports knee pads 3510 and a pivoting extension bar 3504 having two distal transverse foot pads 3508. Cable 2302 is threaded by pulleys 306, 2104, and 2206 from the weight container 1602 to the foot pad end of the extension bar 3504. In a particular embodiment, pedestal 3512 or pillar 3506 may have a pulley similar to seat pedestal pulley 2206.

Figure 36:
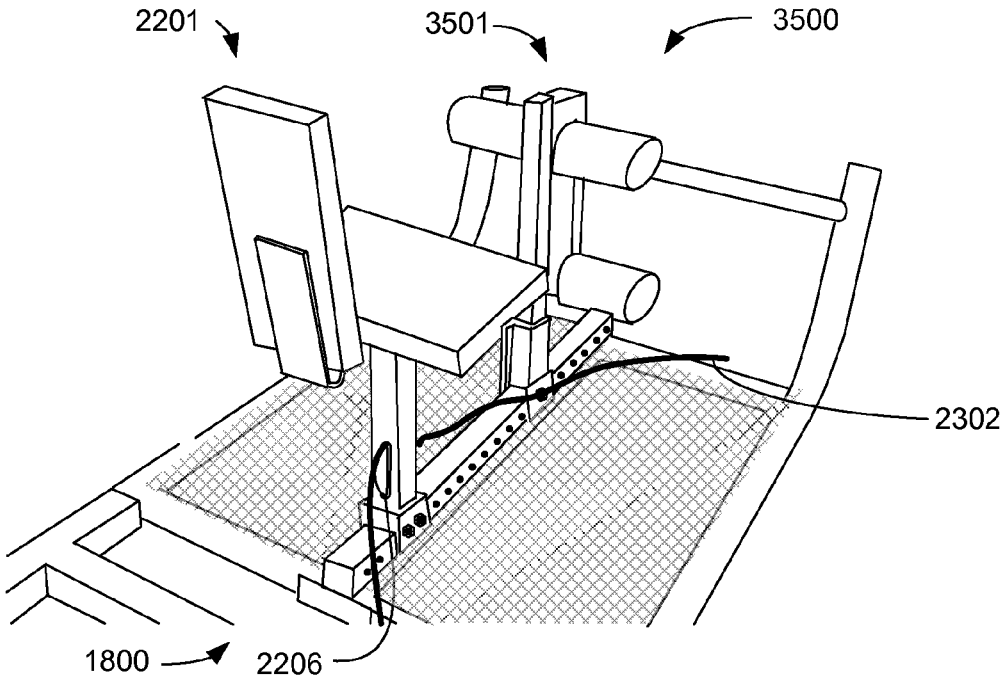
FIG. 36 is a rear-side perspective partial view of the exemplary embodiment of the exemplary sled and adjustable pole support of FIG. 3 and exemplary central attachment bar of FIG. 18, with exemplary embodiments of attachments thereto, of the exemplary embodiment of the exercise equipment system, shown in an operational environment, according to a preferred embodiment of the present invention.

FIG. 36 is a rear-side perspective partial view of the exemplary embodiment of the exemplary sled 100 and adjustable pole support 301 of FIG. 3 and exemplary central attachment bar 1801 of FIG. 18, with exemplary embodiments of attachments 2201 and 3501 thereto, of the exemplary embodiment of the exercise equipment system, shown in an operational environment, according to a preferred embodiment of the present invention. Threading of cable 2302 through seat pedestal pulley 2208 can be more clearly seen in this view.

Figure 37:
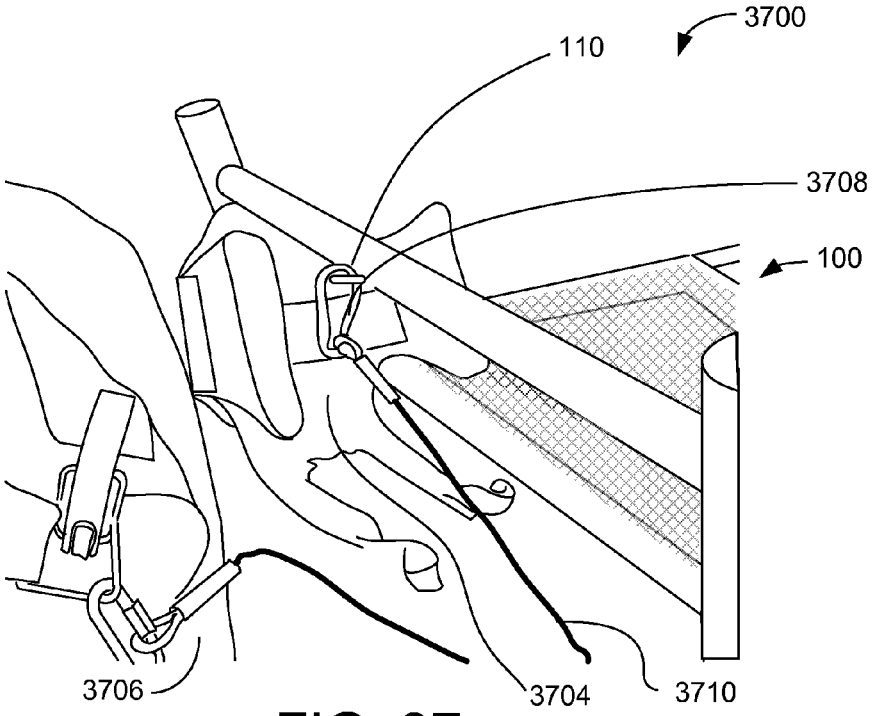
FIG. 37 is a front-side perspective partial view of the exemplary embodiment of the exemplary sled FIG. 1 and exemplary embodiments of towing vests attached thereto, of the exemplary embodiment of the exercise equipment system, shown in an operational environment, according to a preferred embodiment of the present invention.

FIG. 37 is a front-side perspective partial view of the exemplary embodiment 3700 of the exemplary sled 100 FIG. 1 and exemplary embodiments of towing vests 3704 and 3706 attached thereto, of the exemplary embodiment of the exercise equipment system, shown in an operational environment, according to a preferred embodiment of the present invention. The padded towing vests 3704 or the inflated towing vest 3706 is worn by the user and coupled via cable 3710 to carbineer 3708 to attachment point 110 on sled 100. The user tows the weighted sled 100 for exercise.

Figure 38:
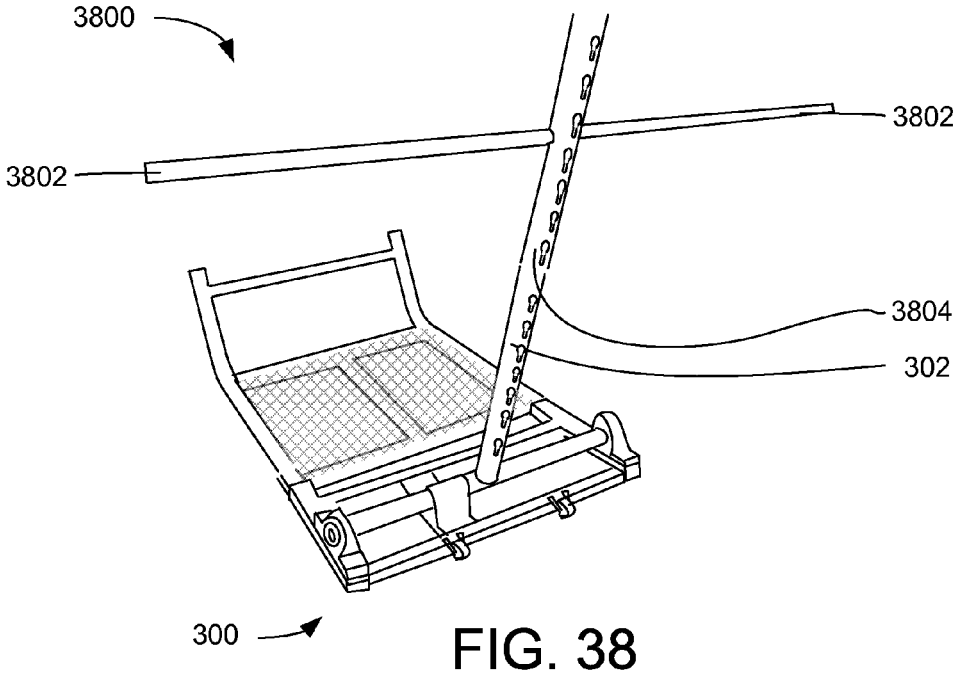
FIG. 38 is a rear-side perspective view of the exemplary embodiment of the exemplary sled and adjustable pole support of FIG. 3 with an exemplary embodiment of a two-man push attachment, of the exemplary embodiment of the exercise equipment system, shown in an operational environment, according to a preferred embodiment of the present invention.

FIG. 38 is a rear-side perspective view of the exemplary embodiment of the exemplary sled 100 and adjustable pole support 1802 of FIG. 3 with an exemplary embodiment of a two-man push attachment 3800, of the exemplary embodiment of the exercise equipment system, shown in an operational environment, according to a preferred embodiment of the present invention. Push rods 3802 are fixed to sleeve 3804 which fits over pole 302 and can be pinned in place. One person pushes on each rod 3802, competing to keep the sled 100, usually weighted with a coach and/or weight containers 1604, moving in a straight line. The sled 100 will veer in the direction of the weaker athlete. In a particular embodiment, rod 3802 may be a single piece that extends through sleeve 3804.

Figure 39:
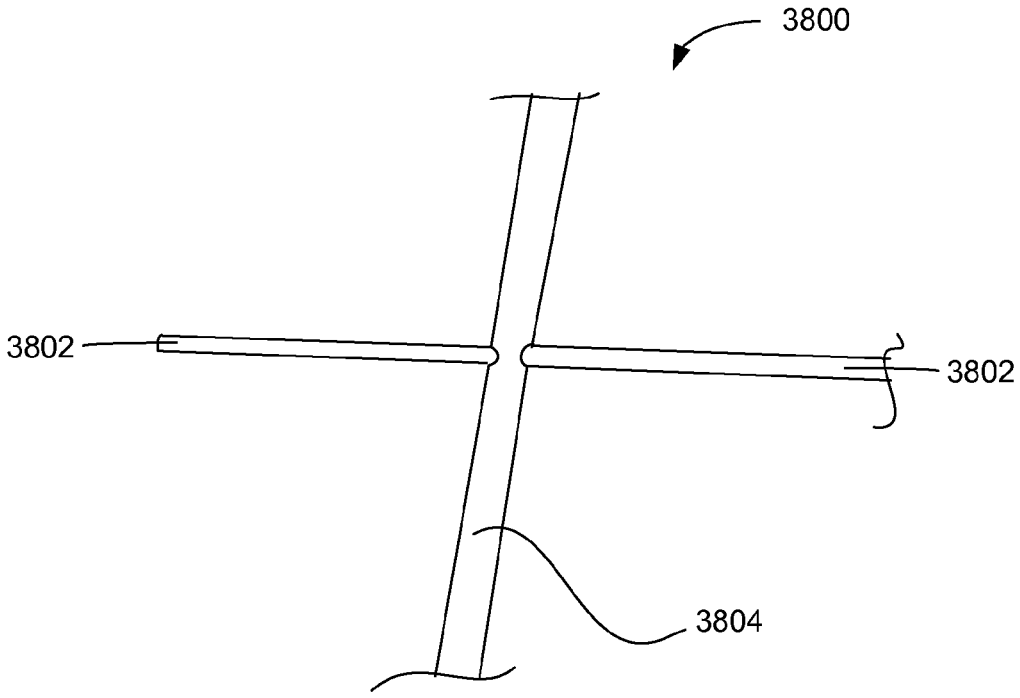
FIG. 39 is a rear-side perspective partial view of the exemplary embodiment of the exemplary embodiment of a two-man push attachment of FIG. 38, of the exemplary embodiment of the exercise equipment system, shown in an operational environment, according to a preferred embodiment of the present invention.

FIG. 39 is a rear-side perspective partial view of the exemplary embodiment of the exemplary embodiment of a two-man push attachment 3800 of FIG. 38, of the exemplary embodiment of the exercise equipment system, shown in an operational environment, according to a preferred embodiment of the present invention. In a particular embodiment, rods 3802 may be attached directly to pole 302.

Figure 40:
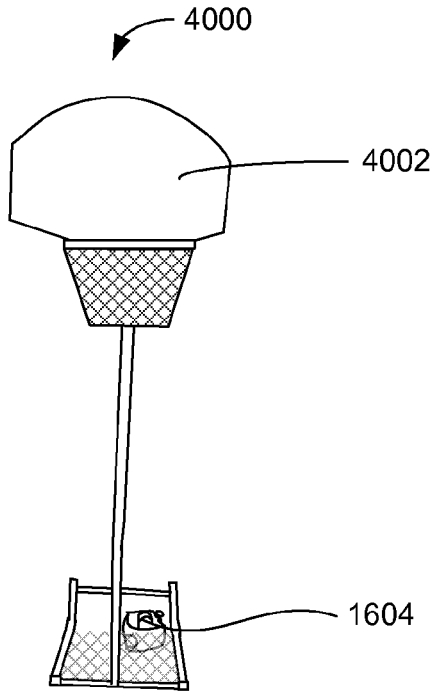
FIG. 40 is a rear perspective partial view of the exemplary embodiment of the exemplary sled and adjustable pole support of FIG. 3 with an exemplary embodiment of a basketball goal attachment, of the exemplary embodiment of the exercise equipment system, shown in an operational environment, according to a preferred embodiment of the present invention.

FIG. 40 is a rear perspective partial view of the exemplary embodiment of the exemplary sled 100 and adjustable pole support 302 of FIG. 3 with an exemplary embodiment of a basketball goal attachment 4002, of the exemplary embodiment of the exercise equipment system, shown in an operational environment, according to a preferred embodiment of the present invention. Appropriate amounts of weight containers 1604 may be placed on the sled 100 to counterbalance forces on the basketball goal 4002, depending on the level of play.

Figure 41:
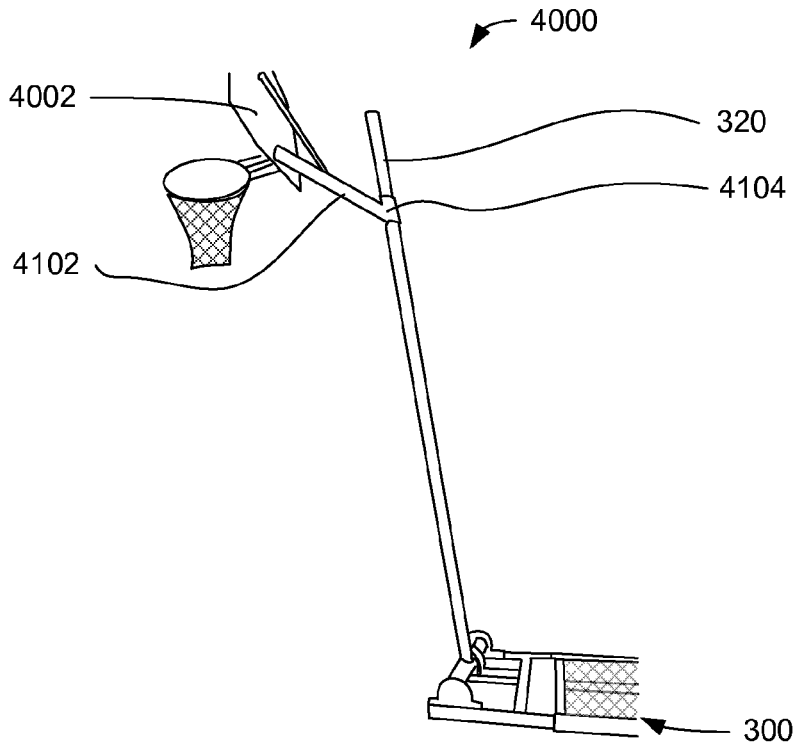
FIG. 41 is a rear-side perspective partial view of the exemplary embodiment of the exemplary sled and adjustable pole support of FIG. 3 with an exemplary embodiment of a basketball goal attachment, shown in an operational environment, of the exemplary embodiment of the exercise equipment system, according to a preferred embodiment of the present invention.

FIG. 41 is a rear-side perspective partial view of the exemplary embodiment of the exemplary sled 100 and adjustable pole support 301 of FIG. 3 with an exemplary embodiment of a basketball goal attachment 4002, of the exemplary embodiment of the exercise equipment system, shown in an operational environment, according to a preferred embodiment of the present invention. Goal support 4102 is attached to pole section 320 via collar 4104. Height may be adjusted by telescoping the pole section 320 or by moving collar 4104.

Figure 42:
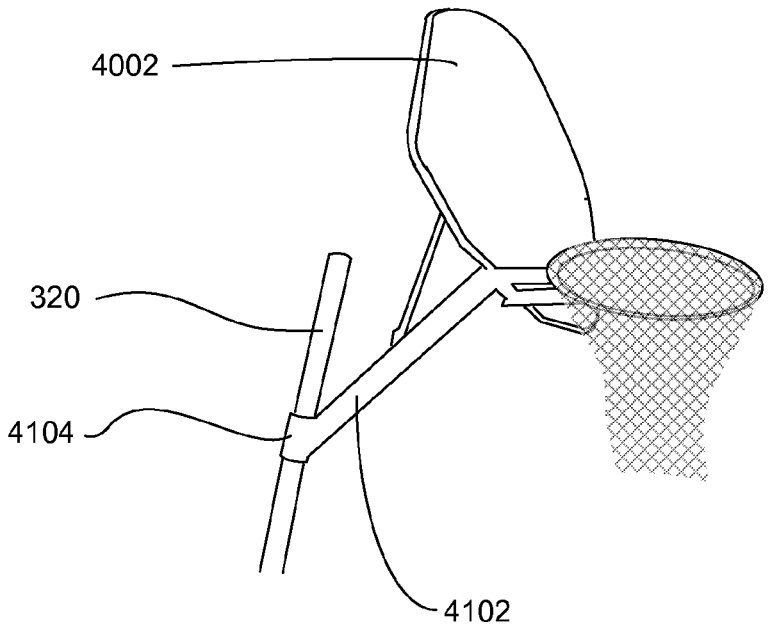
FIG. 42 is a front-side perspective partial view of the exemplary embodiment of the exemplary embodiment of a basketball goal attachment, of the exemplary embodiment of the exercise equipment system, shown in an operational environment, according to a preferred embodiment of the present invention.

FIG. 42 is a front-side perspective partial view of the exemplary embodiment of the exemplary embodiment of a basketball goal attachment 4002, of the exemplary embodiment of the exercise equipment system, shown in an operational environment, according to a preferred embodiment of the present invention. Basketball goal attachment 4002 is exemplary of the wide variety of sports equipment that may be supported by the sled/pole-support combination 300.

Figure 43:
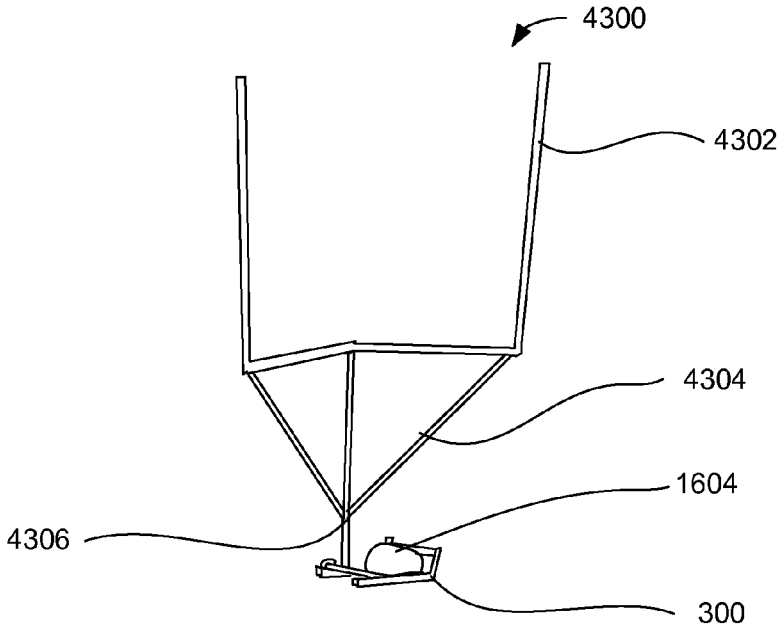
FIG. 43 is a rear-side perspective partial view of the exemplary embodiment of the exemplary sled and adjustable pole support of FIG. 3 with an exemplary embodiment of a football goal attachment, of the exemplary embodiment of the exercise equipment system, shown in an operational environment, according to a preferred embodiment of the present invention.

FIG. 43 is a rear-side perspective partial view of the exemplary embodiment of the exemplary sled 100 and adjustable pole support 301 of FIG. 3 with an exemplary embodiment of a football goalpost attachment 4302, of the exemplary embodiment of the exercise equipment system, shown in an operational environment, according to a preferred embodiment of the present invention. Attachments supporting a variety of sports are within the scope of the present invention, and those shown are merely exemplary and not intended to be limiting. For non-limiting examples, attachments for exercises directly related to baseball, rock climbing, soccer, and volleyball all have embodiments within the scope of the present invention.

Figure 44:
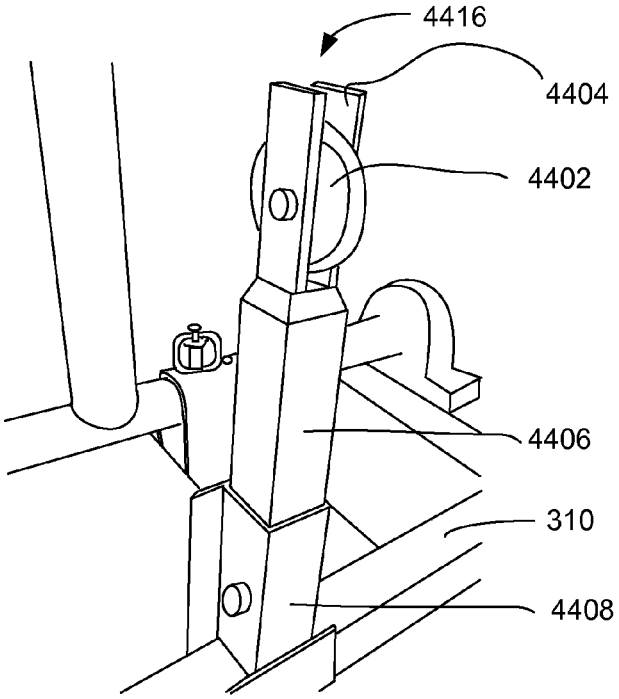
FIG. 44 is a front-side perspective partial view of the exemplary embodiment of the exemplary sled and adjustable pole support of FIG. 3 with an exemplary embodiment of a pedestal pulley mounted on the adjustable pole support of FIG. 3, of the exemplary embodiment of the exercise equipment system, shown in an operational environment, according to a preferred embodiment of the present invention.

FIG. 44 is a front-side perspective partial view of the exemplary embodiment of the exemplary sled 100 and adjustable pole support 301 of FIG. 3 with an exemplary embodiment of a pedestal pulley 4416 mounted on the front frame member 310 of FIG. 3, of the exemplary embodiment of the exercise equipment system, shown in an operational environment, according to a preferred embodiment of the present invention. Pulley support 4404 supports pulley 4402 on pedestal 4406 which is releasably attached to rear frame member 310 via attachment socket 4408.

Figure 45:
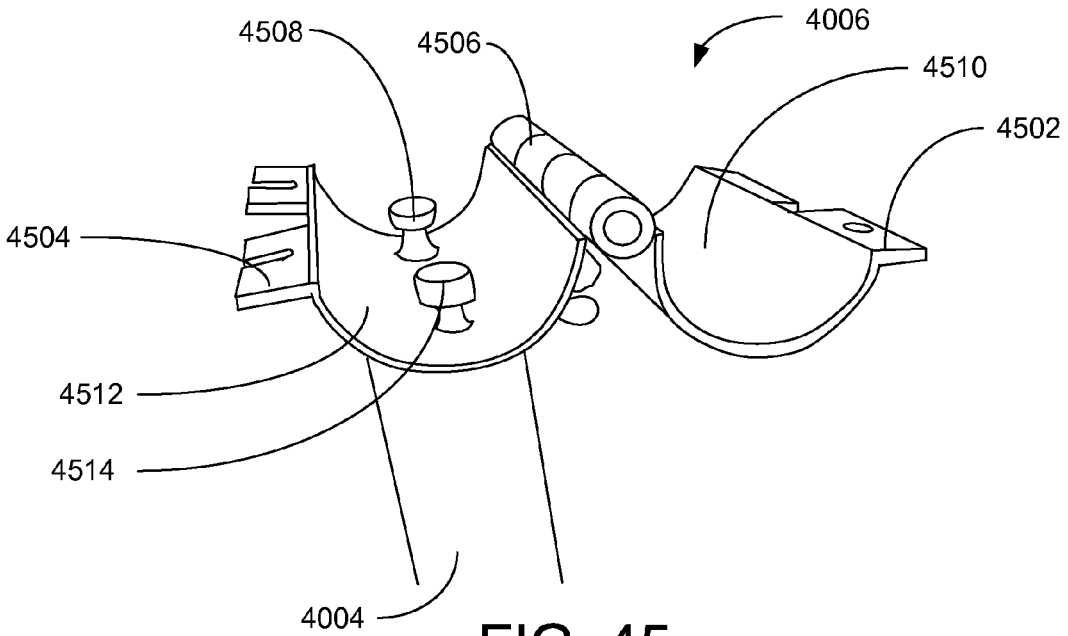
FIG. 45 is a top-side perspective view of the exemplary embodiment of the collar of FIG. 40 in an open configuration, of the exemplary embodiment of the exercise equipment system, shown in an operational environment, according to a preferred embodiment of the present invention.

FIG. 45 is a top-side perspective view of the exemplary embodiment of the collar 4006 of FIG. 40, in an open configuration, of the exemplary embodiment of the exercise equipment system, according to a preferred embodiment of the present invention. Support 4004 attaches to a first semi-cylindrical portion 4512 that has large-headed pins 4508 and 4514 aligned radially inward for engaging keyhole-shaped openings 503 on pole 302. A first edge of the first semi-cylindrical portion has flanges 4504 which have bolt holes to aid fastening. A second edge of the first semi-cylindrical portion 4512 has a hinge 4506 which couples to a second semi-cylindrical portion 4510 that has flanges 4502, with bolt holes, that align to flanges 4504 when the hinge 4506 closes. In operation, the heads of the pins 4508 and 4514 are inserted into the large portion of the keyhole-shaped openings 502 and then moved toward the narrow portion, thus fixing the collar 4006 in place. The hinge 4506 is then closed and the flanges 4502 and 4504 fastened.

Figure 46:
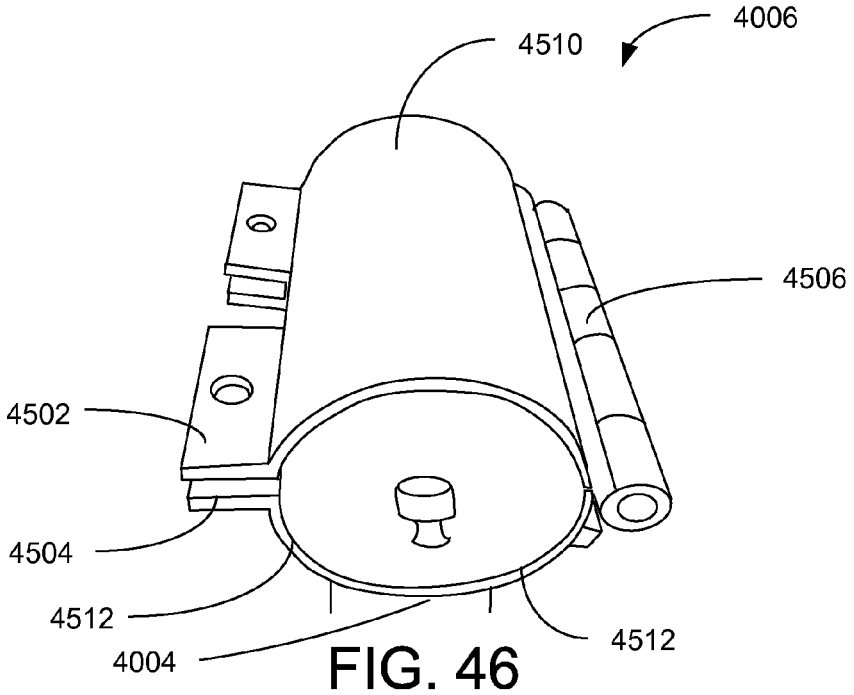
FIG. 46 is a top-side perspective view of the exemplary embodiment of the collar of FIG. 40 in a closed configuration, of the exemplary embodiment of the exercise equipment system, shown in an operational environment, according to a preferred embodiment of the present invention.

FIG. 46 is a top-side perspective view of the exemplary embodiment of the collar 4006 of FIG. 40 in a closed configuration, of the exemplary embodiment of the exercise equipment system, according to a preferred embodiment of the present invention.

Figure 47:
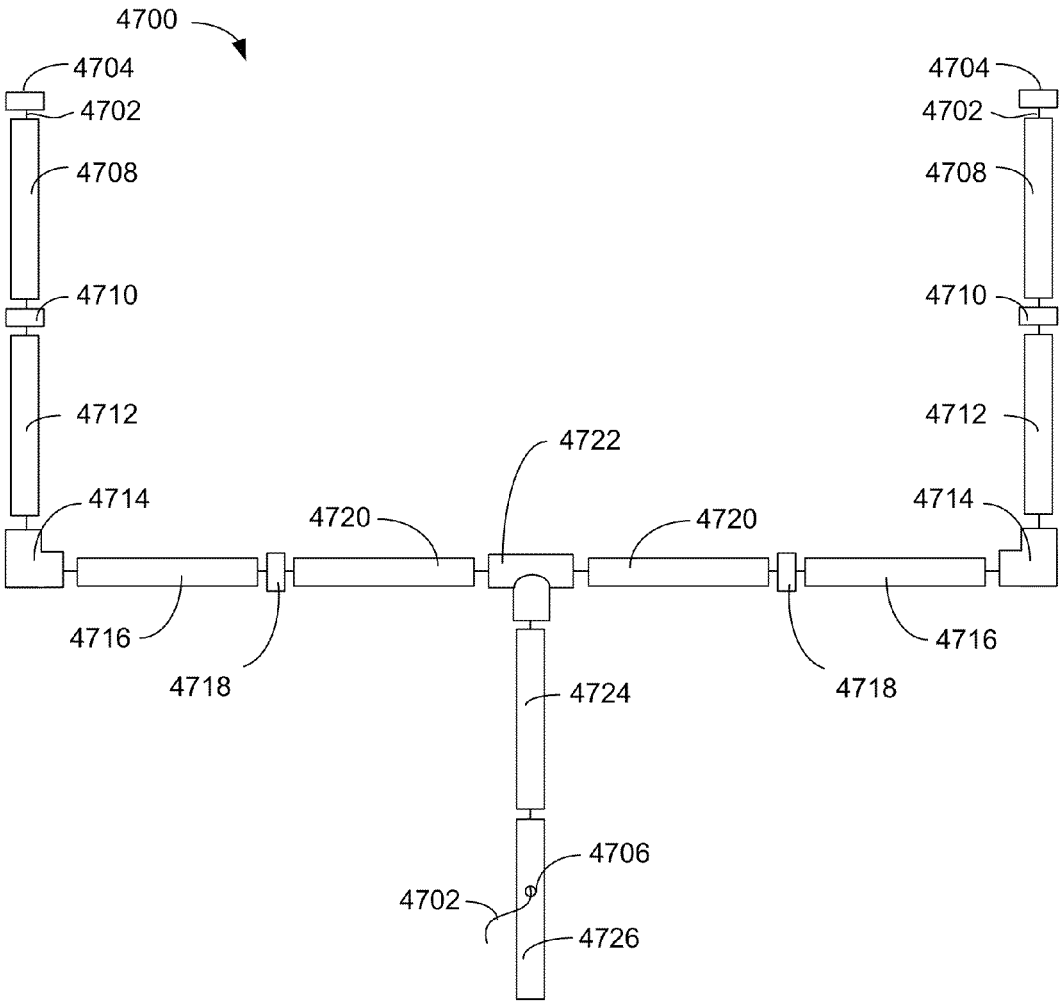
FIG. 47 is a front elevation view of an exemplary embodiment of the goal post of FIG. 43 in a pre-assembly configuration, of the exemplary embodiment of the exercise equipment system, according to a preferred embodiment of the present invention.

FIG. 47 is a front elevation view of an exemplary embodiment of a portion 4700 of the goal post 4302 of FIG. 43, in a pre-assembly configuration, of the exemplary embodiment of the exercise equipment system, according to a preferred embodiment of the present invention. Cable 4702 couples to the inside of end cap 4704 and threads through top upright segment 4708, collar 4710, bottom upright segment 4712, corner coupling 4714, outer cross bar segment 4716, crossbar collar 4718, inner cross bar segment 4720, T-coupling 4722, upper support 4724, and telescoping lower support 4726, which can be coupled to adjustable pole support 301 attached to sled 100 as shown in FIG. 3. Lower support 4726 has opening 4706 through which cable 4702 emerges to engage a manually operated winch or other prime mover that is mounted on sled 100. Left and right sides of goal post portion 4700 are mirror images. Cable 4702 may be two cables 4702 that merge into one cable 4702 below the T-coupling 4722, or may be two cables 4702 all the way to the winch. Winding cable 4702 pulls the goal post portion 4700 from the unassembled configuration to the assembled configuration.

Cable 4702 is merely exemplary, and various forms on connectors, such as locking hinges, may be used in various embodiments. The essential matter is that the goal post portion 4700 fold up into lengths no greater than the length of sled 100, for packing and shipping purposes.

Figure 48:
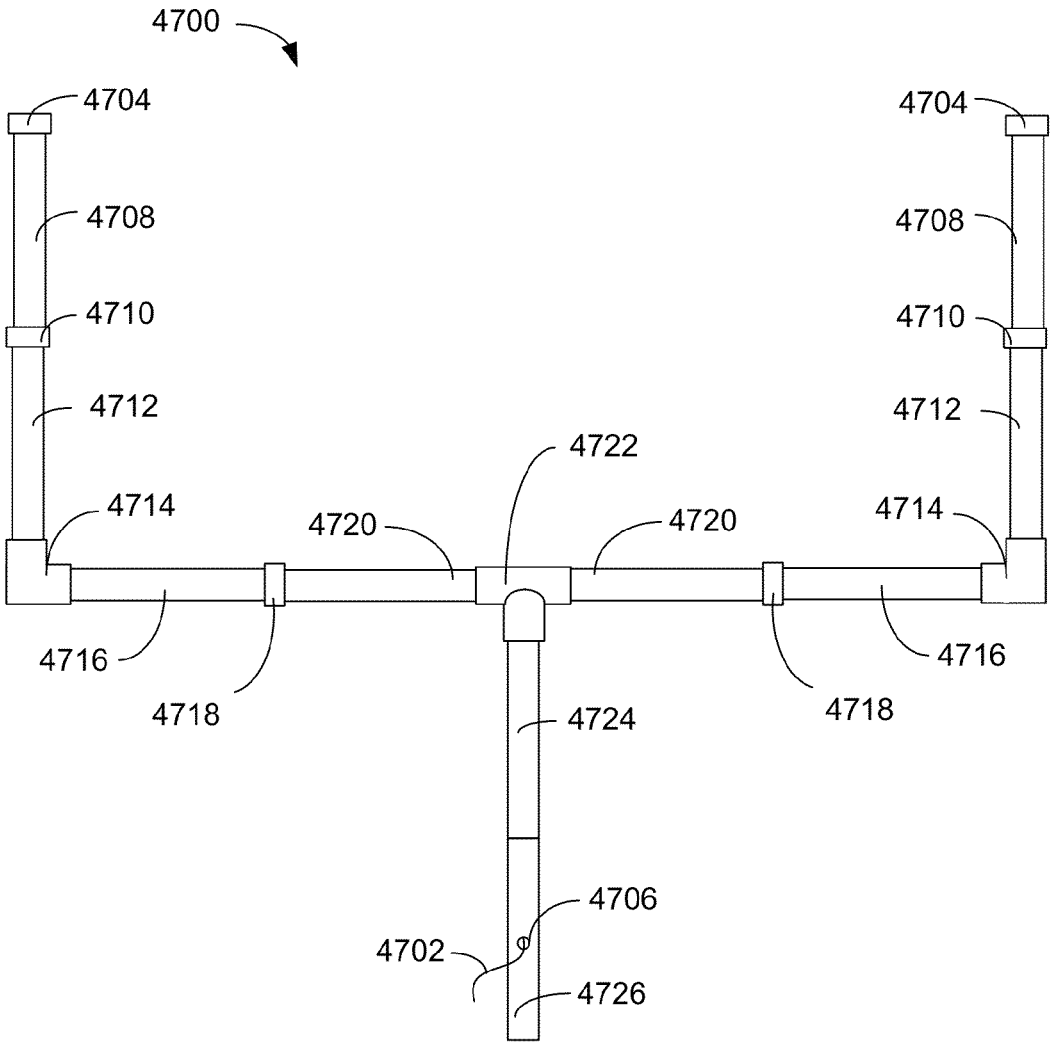
FIG. 48 is a front elevation view of an exemplary embodiment of the goal post of FIG. 43 in an assembled configuration, of the exemplary embodiment of the exercise equipment system, according to a preferred embodiment of the present invention.

FIG. 48 is a front elevation view of an exemplary embodiment of a portion 4700 of the goal post 4302 of FIG. 43, in an assembled configuration, of the exemplary embodiment of the exercise equipment system, according to a preferred embodiment of the present invention. In a particular embodiment, collars 4710 and 4718, as well as couplings 4714 and 4722 may have slots that align to keys on segments 4708, 4712, 4716, 4720, and 4724 to support correct rotational configuration at each joint.

Although applicant has described applicant's preferred embodiments of this invention, it will be understood that the broadest scope of this invention includes such modifications as diverse shapes and sizes and materials. Such scope is limited only by the above specification and the claims below.

Further, many other advantages of applicant's invention will be apparent to those skilled in the art from the above descriptions.

I claim:

1. An exercise equipment system comprising:

a. a sled having first and second spaced-apart parallel runners made of pipe having first and second rear straight portions, respectively, and first and second front upwardly extending portions, respectively, extending from first and second forward ends of said first and second rear straight portions, respectively;

b. first and second rear ends of said first and second rear straight portions, wherein said first and second rear ends are shaped to a square cross-section;

c. first and second end couplings, having a cross section of three sides of a square, extending from said first and second rear ends of said first and second rear straight portions, respectively, and operable to slidingly receive first and second square attachment covers, respectively;

d. a rear crossbar extending between said first and second rear ends of said first and second rear straight portions, respectively;

e. a front crossbar extending between said first and second front ends of said first and second rear straight portions, respectively;

f. a top crossbar extending between said first and second upwardly extending portions;

g. a central support parallel to and midway between said runners and extending between said front and rear crossbars;

h. a floor panel attached to and extending between said front and rear crossbars and between said first and second rear straight portions;

i. first and second square attachment covers alignable to said first and second end couplings, respectively; and j. a frame comprising first and second side members and front and rear cross members coupled to said first and second side members in a rectangular configuration, said frame supporting:

i. said first and second square attachment covers extending from front ends of said first and second side members, respectively;

ii. first and second pole axle bearings mounted on said first and second side members, respectively;

iii. first and second casters mounted on said rear cross member;

iv. first and second stabilizers extendable rearwardly from within said first and second side members, respectively;

v. an angular adjuster support mounted between said front and rear cross members.

2. The exercise equipment system of claim 1, comprising at least one weight container that can contain a liquid as a weight, wherein said weight container is one of supported on said floor panel and attached to a cable that a user can move to accomplish an exercise.

3. The exercise equipment system of claim 1, further comprising a central attachment bar releasably attached to said sled above said floor panel and aligned to said central support, wherein said central attachment bar comprises an array of openings for receiving fasteners for fastening at least one exercise equipment component to said central attachment bar.

4. The exercise equipment system of claim 3, wherein said at least one exercise equipment component comprises at least one of:

a. at least one socket for receiving and retaining at least one of a pillar and a pedestal of at least one exercise equipment component;

b. a pedestal-supported chair;

c. a pedestal-supported pulley;

d. a pedestal-supported chair having a pulley in said pedestal;

e. a pedestal-supported bench seat;

f. a pedestal-supported inclined bench;

g. a pedestal-supported arm rest; and h. a pedestal-supported leg extension apparatus.

5. The exercise equipment system of claim 1, further comprising:

a. a pole axle supported by said first and second pole axle bearings, said pole axle having two semi-circumferential arrays of holes and operable to be releasably fixed in one of a plurality of discrete angular positions by use of said angular adjuster support having alignable holes and a pin; and b. a pole fixed transverse to said pole axle and having a first portion of a telescopic coupling.

6. The exercise equipment system of claim 5, wherein said pole supports one of a punching bag, a two-athlete push bar, and a football goal.

7. The exercise equipment system of claim 6, wherein said football goal comprises an erectable football goal that is collapsible to a length no greater than said sled.

8. The exercise equipment system of claim 5, further comprising first and second bench press rack supports supported on said first and second side members, respectively.

9. The exercise equipment system of claim 5, further comprising at least one extension of said pole having a second portion of said telescopic coupling complimentary to said first portion of said telescopic coupling.

10. The exercise equipment system of claim 9, wherein said at least one extension comprises an extension having a pulley mounted on an end of said extension distal from said second portion of said telescopic coupling.

11. The exercise equipment system of claim 5, comprising a plurality of axially aligned and spaced apart keyhole-shaped openings in said pole.

12. The exercise equipment system of claim 11, comprising:

a. a hinged bifurcated cylindrical collar sized to encircle said pole when in a closed configuration;

b. said collar having at least two pins extending radially inward and spaced apart with the same spacing as said spaced apart keyhole-shaped openings;
c. each said at least two pins having a head large enough to be inserted into a larger end of one of said keyhole-shaped openings and too large to be inserted through a narrow end of one of said keyhole-shaped openings;
d. each said at least two pins having a stem having a diameter smaller than said narrow end of one of said keyhole-shaped openings;
e. fastening adaptations for assisting in fastening said collar in said closed configuration; and
f. a support extending from an exterior surface of said collar.

13. The exercise equipment system of claim 12, wherein said support extending from said exterior surface of said collar supports at least one of:
a. a speed bag frame, a speed bag deflector, and a speed bag;
b. an inverted speed bag frame and a bob-and-weave bag;
c. a pulley; and
d. a basketball goal.

14. An exercise equipment system comprising:
a. a sled having first and second spaced-apart parallel runners made of cylindrical pipe having first and second rear straight portions, respectively, each having first and second rear ends with square cross sections, respectively;
b. first and second end couplings, each having a cross section of three sides of a square, extending from said first and second rear ends of said first and second rear straight portions, respectively, and operable to slidingly receive first and second square attachment covers, respectively;
c. a plurality of crossbars extending between said first and second spaced-apart parallel runners;
d. a central support parallel to and midway between said runners;
e. a floor panel attached to at least two crossbars of said plurality of crossbars and between said first and second runners;
f. a central attachment bar releasably attached to said sled above said floor panel and aligned to said central support, wherein said central attachment bar comprises an array of openings for receiving fasteners for fastening at least one exercise equipment component to said central attachment bar;
g. first and second square attachment covers alignable and releasably attachable to said first and second end couplings, respectively; and
h. a frame comprising first and second side members and front and rear cross members coupled to said first and second side members in a rectangular configuration, said frame supporting:
   i. said first and second square attachment covers extending from front ends of said first and second side members, respectively;
   ii. first and second pole axle bearings mounted on said first and second side members, respectively;
   iii. first and second casters mounted on said rear cross member;
   iv. first and second stabilizers extendable rearwardly from within said first and second side members, respectively;
   v. an angular adjuster support mounted between said front and rear cross members.

15. The exercise equipment system of claim 14, further comprising:
a. a pole axle supported by said first and second pole axle bearings, said pole axle operable to be releasably fixed in one of a plurality of discrete angular positions assisted by use of said angular adjuster support; and
b. a pole fixed transverse to said pole axle and having a first portion of a telescopic coupling, wherein said pole is operable to:
   i. support articles of exercise equipment;
   ii. suspend articles of exercise equipment;
   iii. support at least one pulley for guiding a cable between a weight container and a user; and
   iv. support telescopic extensions to said pole which can support and suspend articles of exercise equipment and support at least one pulley for guiding a cable between a weight container and a user.

16. The exercise equipment system of claim 15, comprising:
a. a plurality of axially aligned and spaced apart keyhole-shaped openings in said pole;
b. a hinged bifurcated cylindrical collar sized to encircle said pole when in a closed configuration;
c. said collar having at least two pins extending radially inward and spaced apart with the same spacing as said spaced apart keyhole-shaped openings;
d. each said at least two pins having a head large enough to be inserted into a larger end of one of said keyhole-shaped openings and too large to be inserted through a narrow end of one of said keyhole-shaped openings;
e. each said at least two pins having a stem having a diameter smaller than said narrow end of one of said keyhole-shaped openings;
f. fastening adaptations for assisting in fastening said collar in said closed configuration; and
g. an exercise equipment support extending from an exterior surface of said collar.

17. The exercise equipment system of claim 14, comprising at least one weight container operable to contain a liquid as a weight, wherein said weight container is one of supported on said floor panel and attached to one of a cable and a flexibly attached handle that a user can move to accomplish an exercise.

18. An exercise equipment system comprising:
a. a sled having first and second spaced-apart parallel runners made of cylindrical pipe having first and second rear straight portions, respectively, each having first and second rear ends with square cross sections, respectively;
b. first and second end couplings, each having a cross section of three sides of a square, extending from said first and second rear ends of said first and second rear straight portions, respectively, and operable to slidingly receive first and second square attachment covers, respectively;
c. a plurality of crossbars extending between said first and second spaced-apart parallel runners;
d. a floor panel attached to at least two crossbars of said plurality of crossbars and between said first and second runners;
e. an exercise equipment attachment bar on said floor panel;
f. first and second square attachment covers alignable and releasably attachable to said first and second end couplings, respectively;
g. a frame comprising first and second side members and front and rear cross members coupled to said first and second side members in a rectangular configuration, said frame supporting:

i. said first and second square attachment covers extending from front ends of said first and second side members, respectively;

ii. first and second pole axle bearings mounted on said first and second side members, respectively;

iii. first and second stabilizers extendable rearwardly from within said first and second side members, respectively;

iv. an angular adjuster support mounted between said front and rear cross members.

19. The exercise equipment system of claim 18, further comprising:

a. a pole axle supported by said first and second pole axle bearings, said pole axle operable to be releasably fixed in one of a plurality of discrete angular positions assisted by use of said angular adjuster support; and b. a pole fixed transverse to said pole axle and having a first portion of a telescopic coupling distal to said pole axle, wherein said pole is operable to:

i. support articles of exercise equipment;

ii. suspend articles of exercise equipment;

iii. support at least one pulley for guiding a cable between a weight container and a user; and iv. support telescopic pole extensions to said pole which can support and suspend articles of exercise equipment and support at least one pulley for guiding a cable between a weight container and a user.

20. The exercise equipment system of claim 18, comprising at least one weight container operable to contain a liquid as a weight, wherein said weight container is one of supported on said floor panel and attached to one of a cable and a flexibly attached handle that a user can move to accomplish an exercise.

* * * * *